US007634927B1

(12) United States Patent
Tien

(10) Patent No.: US 7,634,927 B1
(45) Date of Patent: Dec. 22, 2009

(54) PANIC EXIT DOOR LOCK ALLOWING LOCKING ON BOTH SIDES

(75) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 12/365,217

(22) Filed: Feb. 4, 2009

(51) Int. Cl.
*E05B 65/10* (2006.01)

(52) U.S. Cl. ..... 70/92; 70/107; 70/111; 70/210; 70/379 R; 70/380; 70/465; 70/467; 70/485; 70/DIG. 60; 292/21; 292/92; 292/336.3

(58) Field of Classification Search ..... 70/92, 70/465, 107–111, DIG. 60, 467–471, 483–485, 70/150, 153, 210, 224, 104–106, DIG. 63, 70/379 R, 379 A, 380; 292/21, 92–94, 336.3
See application file for complete search history.

(56) References Cited

U.S. PATENT DOCUMENTS

| | | | | | |
|---|---|---|---|---|---|
| 3,271,982 | A * | 9/1966 | Welch | 70/92 |
| 3,334,500 | A * | 8/1967 | Bejarano | 70/92 |
| 3,464,242 | A * | 9/1969 | Sakuzo | 70/134 |
| 4,236,396 | A * | 12/1980 | Surko et al. | 70/107 |
| 4,276,760 | A * | 7/1981 | Nolin | 70/107 |
| 4,683,733 | A * | 8/1987 | Marin | 70/134 |
| 4,741,563 | A | 5/1988 | Cohrs | 292/21 |
| 4,961,330 | A | 10/1990 | Evans | 292/21 |
| 4,974,890 | A | 12/1990 | Cohrs | 292/363.3 |
| 4,979,767 | A * | 12/1990 | Lin | 292/336.3 |
| 4,982,986 | A * | 1/1991 | Gressett et al. | 292/336.3 |
| 5,412,961 | A * | 5/1995 | Cain et al. | 70/92 |
| 5,492,380 | A * | 2/1996 | Smallegan et al. | 292/336.3 |
| 5,520,427 | A | 5/1996 | Mader | 292/336.3 |
| 5,564,760 | A | 10/1996 | Mader | 292/182 |
| 5,566,994 | A | 10/1996 | Mader | 292/336.3 |
| 5,570,916 | A | 11/1996 | Mader | 292/336.3 |
| 5,658,026 | A * | 8/1997 | Nigro et al. | 292/336.3 |
| 5,664,816 | A * | 9/1997 | Nigro et al. | 292/336.3 |
| 6,354,121 | B1 * | 3/2002 | Frolov | 70/277 |
| 7,181,940 | B2 * | 2/2007 | Lin | 70/472 |
| 7,287,787 | B1 * | 10/2007 | Tannone | 292/336.3 |
| 7,364,212 | B1 | 4/2008 | Fan | 292/336.3 |
| 2005/0053227 | A1 * | 3/2005 | Fortier | 379/390.04 |
| 2006/0043742 | A1 * | 3/2006 | Huang et al. | 292/336.3 |
| 2007/0114801 | A1 * | 5/2007 | Lin | 292/336.3 |

* cited by examiner

*Primary Examiner*—Lloyd A Gall
(74) *Attorney, Agent, or Firm*—Alan Kamrath; Kamrath & Associates PA

(57) ABSTRACT

A panic exit door lock includes a cover (20) mounted to an outer side (10*b*) of a door (10). A sliding member (34) is slideably received in the cover (20) and operably connected to a latch (12). A handle (24) is pivotably mounted to the cover (20) and operably connected to the sliding member (34) such that rotation of the handle (24) causes sliding of the sliding member (34) to move the latch between an extended position and a retracted position. A limiting member (32) is pivotably received in the cover (20) between a blocking position not allowing movement of the sliding member (34) and a release position allowing movement of the sliding member (34). An inner lock core (54) and an outer lock core (270) are respectively mounted to an inner side (10*a*) and the outer side (10*b*) of the door (10). Either of the inner and outer lock cores (54, 270) can be rotated by a key to move the limiting member (32) between the blocking position and the release position.

11 Claims, 17 Drawing Sheets

PANIC EXIT DOOR LOCK ALLOWING LOCKING ON BOTH SIDES

BACKGROUND OF THE INVENTION

The present invention relates to a panic exit door lock and, more particularly, to a panic exit door lock that allows locking on both inner and outer sides of a panic exit door for deadlocking purposes.

Panic exit door locks generally include an outer operational device that provides a deadlocking effect through a setting operation from an outer side of a panic exit door. An example of the lockable panic exit door locks is disclosed in U.S. patent application Ser. No. 12/264,310 filed Nov. 14, 2008. However, the deadlocking function of the conventional locks can not be set or removed from an inner side of the panic exit door.

Thus, a need exists for a panic exit door lock that allows locking on both inner and outer sides of a panic exit door for deadlocking purposes.

BRIEF SUMMARY OF THE INVENTION

The present invention solves this need and other problems in the field of deadlocking function setting of panic exit door locks by providing, in a preferred form, a panic exit door lock including a base adapted to be mounted to an inner side of a door. A sliding device is slideably mounted to the base. A latch is operably coupled to the sliding device and movable between an extended, latching position and a retracted, unlatching position. A cover is adapted to be mounted to an outer side of the door. A sliding member is slideably received in the cover and operably connected to the sliding device. A handle is pivotably mounted to the cover and operably connected to the sliding member such that rotation of the handle causes sliding of the sliding member, moving the latch between the extended, latching position and the retracted, unlatching position. A limiting member is pivotably received in the cover between a blocking position not allowing movement of the sliding member and a release position allowing movement of the sliding member. The handle is rotatable when the limiting member is in the release position, and the handle is not rotatable when the limiting member is in the blocking position. An outer cylinder includes an outer cylinder body mounted to the cover and an outer cylinder core rotatably received in the outer cylinder body. An actuating block is fixed to the outer cylinder core to rotate therewith. A driving member is fixed to the sliding member to move therewith. The driving member includes a rod coupled to the sliding device. A mover is rotatably mounted around the cylinder and includes a tab and an actuating bar. The tab is operably connected to the actuating block. The actuating bar is operably connected to the limiting member. The mover is rotated to move the limiting member between the blocking position and the release position when the actuating block is rotated by rotating the outer lock core. A casing is mounted to the inner side of the door. An inner cylinder includes an inner cylinder body mounted to the casing and an inner lock core rotatably received in the inner cylinder body. A driving block is rotatably mounted around the actuating block and operably connected to the tab of the mover. A tongue includes front and rear ends spaced in a longitudinal direction. The rear end is fixed to the inner lock core, and the front end is coupled to the driving block, allowing joint rotation of the inner lock core, the tongue, and the driving block. The mover is rotated to move the limiting member between the blocking position and the release position when the driving block is rotated by rotating the inner lock core.

In the most preferred form, the actuating block includes a main portion having an ear extending radially outward from an outer periphery of the main portion. The ear drives the tab of the mover to rotate the mover when the outer lock core is rotated, moving the limiting member between the blocking position and the releasing position. The main portion includes a coupling portion extending from a side thereof. The driving block includes first and second ends spaced in the longitudinal direction. The first end of the driving block includes a receptacle rotatably receiving the coupling portion. A lug extends radially outward from an outer periphery of the first end of the driving block. The lug drives the tab of the mover to rotate the mover when the inner lock core is rotated, moving the limiting member between the blocking position and the releasing position. The coupling portion includes an annular groove in the outer periphery thereof. The driving block includes an engaging hole extending from an outer periphery of the driving block to the receptacle in a radial direction perpendicular to the longitudinal direction. A resilient clip has a first end extending through the engaging hole into the annular groove of the coupling portion. The resilient clip further includes a second end abutting the outer periphery of the driving block, allowing relative rotation between the actuating block and the driving block and preventing relative movement between the actuating block and the driving block in the longitudinal direction.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
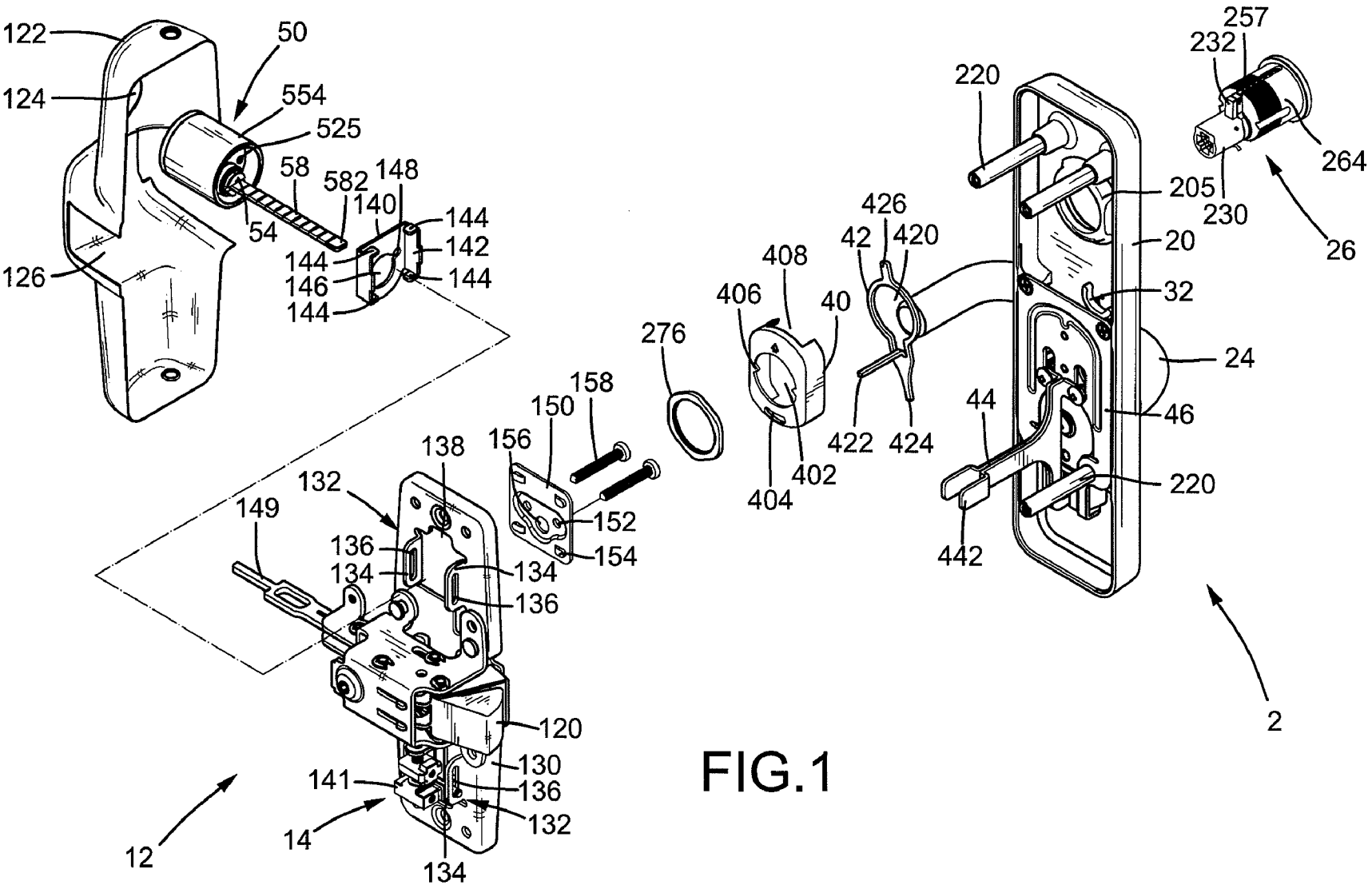
FIG. 1 shows an exploded, perspective view of a panic exit door lock according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "side", "end", "portion", "section", "axial", "lateral", "horizontal", "vertical", "annular", "inward", "spacing", "clockwise", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A panic exit door lock according to the preferred teachings of the present invention is shown in the drawings and adapted to be mounted to a door 10 in the preferred form shown as a panic exit door. According to the preferred form shown, the lock includes a latch device 12 mounted to an inner side 10*a* of door 10, an outer operational device 2 mounted to an outer side 10*b* of door 10, and a locking mechanism 3 mounted between latch device 12 and outer operational device 2. Door 10 includes a mounting hole 106 for receiving components of latch device 12, locking mechanism 3, and outer operational device 12. Latch device 12 allows a user to open door 10 from inner side 10*a*, outer operational device 2 allows the user to open door 10 from outer side 10*b*, and locking mechanism 3 allows the user to set the lock in a locked state or unlock from inner side 10*a* or outer side 10*b*. When the lock is in the locked state, door 10 can not be opened through operation of outer operational device 2. On the other hand, when the lock is in an unlocked state, operation of outer operational device 12 can open door 10.

According to the preferred form shown, latch device 12 includes a base 130 fixed to inner side 10*a* of door 10. Base 130 includes upper and lower slots 138 in upper and lower portions. Base 130 further includes an upper guiding mechanism 132 formed on a side thereof. Upper guiding mechanism 132 includes parallel, spaced tabs 134 on two sides of upper slot 138 and having aligned vertical tracks 136 extending in a vertical direction. The side of base 130 further includes a lower guiding mechanism 132 including parallel, spaced tabs 134 on two sides of lower slot 138 and having aligned vertical tracks 136 extending in the vertical direction. A sliding device 14 includes a slide 141 slideably received in vertical tracks 136 of lower guiding mechanism 132. A linking rod 149 is slideably mounted between upper and lower guiding mechanisms 132 and operably coupled to a latch 120, so that movement of linking rod 149 in a horizontal direction perpendicular to the vertical direction causes movement of latch 120 between an extended, latching position and a retracted, unlatching position. In the most preferred form shown, a link 133 is mounted between linking rod 149 and slide 141. Specifically, link 133 is pivotably connected to linking rod 149 and to slide 141. Furthermore, link 133 is pivotably connected to base 130. When slide 141 moves in the vertical direction, link 133 pivots to move linking rod 149 in the horizontal direction.

According to the preferred form shown, base 130 is housed in a casing 122 that includes a receiving hole 124 aligned with upper guiding mechanism 132. Casing 122 further includes a notch 126 in a side thereof through which latch 120 extends. An operative member 162 in the most preferred form shown as a press bar is pivotably mounted to inner side 10*a* of door 10 and operably connected to linking rod 149. Operative member 162 can be operated to move linking rod 149 in the horizontal direction to retract latch 120.

According to the preferred form shown, outer operational device 2 includes a cover 20 having a sidewall 202 extending in a vertical direction and an annular wall 204 extending perpendicularly along a periphery of sidewall 202, defining a space 200 between annular wall 204 and sidewall 202. Sidewall 202 includes a receiving portion 205 in an upper portion thereof. Receiving portion 205 extends into space 200 and forms a compartment 206. Furthermore, receiving portion 205 includes two parallel, spaced, chamfered faces 209 on an outer periphery thereof. Compartment 206 includes an opening 208 in communication with space 200. Sidewall 202 further includes upper and lower fixing holes 210 below opening 208. Sidewall 202 further includes an engaging hole 214 below fixing holes 210. A protrusion 215 extends from an inner face of sidewall 202 below engaging hole 214. Protrusion 215 includes a first groove 216 and a second groove 219 above first groove 216 and shallower than first groove 216 in a depth direction perpendicular to the vertical direction. Two pegs 218 are formed on the inner face of sidewall 202 and located above opening 208. Annular wall 204 includes two supports 217 on two inner, vertical faces thereof. Each support 217 has a height from sidewall 202 the same as that of protrusion 215. Sidewall 202 further includes a positioning hole 212 adjacent to upper fixing hole 210.

Two mounting posts 220 are engaged with screw holes in pegs 218. Furthermore, two additional mounting posts 220 are engaged with screw holes in protrusions 215. Cover 20 is mounted to outer side 10*b* of door 10 and covers mounting hole 106, with annular wall 204 abutting outer side 10*b* and with each mounting post 220 extending through mounting hole 106 to a position adjacent to base 130. A fastener 108 in the most preferred form shown as a screw is extended through base 130 into a screw hole in an end of each mounting post 220, so that base 130 is fixed to inner side 10*a* of door 10 and that cover 20 is fixed to outer side 10*b* of door 10.

According to the preferred form shown, outer operational device 2 further includes a sleeve 22 mounted to an outer face of sidewall 202 and in the most preferred form shown as a truncated cone. Sleeve 22 includes a central pivot hole 222 aligned with engaging hole 214 of cover 20. Fasteners 224 are extended through sidewall 202 into holes 226 in an end face of sleeve 22 to fix sleeve 22 on cover 20.

According to the preferred form shown, outer operational device 2 further includes a handle 24 having a stem 240 adapted to be gripped by a user and a shank 242 extending from an end of stem 240. Shank 242 includes an engaging portion 244 in the most preferred form shown having two chamfered faces 246 so that engaging portion 244 has non-circular cross sections. Shank 242 is pivotably received in pivot hole 222 of sleeve 22 about a pivot axis with engaging portion 244 outside of pivot hole 222. A retainer ring 248 in the most preferred form shown as a C-clip is mounted in an annular groove of shank 242 to prevent axial movement of handle 24 along the pivot axis.

According to the preferred form shown, outer operational device 2 further includes an actuating member 36 having a connecting hole 364 in an intermediate portion thereof. Two diametrically opposed rectangular grooves 366 are formed in an inner periphery of connecting hole 364. Actuating member 36 further includes first and second ends 360 and 362 on opposite sides of connecting hole 364. Shank 242 of handle 24 is pivotably received in connecting hole 364, so that actuating member 36 is pivotable relative to shank 242 of handle 24. Actuating member 36 abuts a side of retainer ring 248.

According to the preferred form shown, outer operational device 2 further includes a follower 38 in the most preferred form shown as a ring. Follower 38 includes a non-circular hole 382 corresponding to non-circular engaging portion 244 of handle 24 and extending along a central axis thereof. Follower 38 further includes two diametrically opposed teeth 380 extending in a direction parallel to and spaced from the central axis of follower 38. Engaging portion 244 of handle 24 is received in non-circular hole 382 of follower 38, with follower 38 intermediate actuating member 36 and retainer ring 248 and with teeth 380 engaged in grooves 366. Thus, handle 24 and follower 38 rotate jointly due to non-circular hole 382 and non-circular engaging portion 244. Furthermore, since teeth 380 of follower 38 engaged in groves 366 of actuating member 36, rotation of handle 24 also causes rotation of actuating member 36.

According to the preferred form shown, outer operational device 2 further includes a guide block 352 mounted in first groove 216 of cover 20 and having a size corresponding to first groove 216 of cover 20. Guide block 352 includes a sliding groove 353 extending in a vertical direction.

According to the preferred form shown, outer operational device 2 further includes an inner lid 46 having an opening 466 through which engaging portion 244 of handle 24 extends. A bend 466 is formed on an inner periphery of opening 466. Inner lid 46 further includes two parallel, spaced, elongated slots 460 above opening 466. Inner lid 46 further includes a support 464 below opening 466. Support 464 is formed by bending a portion of inner lid 46 and includes a vertical section 470 and a horizontal section 472. Inner lid 46 abuts protrusion 215 and supports 217, and fasteners 468 are extended through inner lid 46 into screw holes in supports 217. Two of mounting posts 220 are extended through inner lid 46 into screw holes in protrusion 215. Thus, inner lid 46 is fixed in space 200 of cover 20. Vertical section 470 of support 464 abuts two lateral walls of first groove 216 such that guide block 352 can not move in first groove 216 along a horizontal direction perpendicular to the vertical direction. Horizontal section 472 of support 464 abuts end faces of the lateral walls of first groove 216 such that guide block 352 can not move in the vertical direction.

According to the preferred form shown, outer operational device 2 further includes a returning device 28 having a body 296 having a non-circular outer periphery. Body 296 includes a lobe 300 on a lower end thereof and having rectangular cross sections. Body 296 further includes a compartment 298 in a side thereof. Compartment 298 forms an engaging groove 302 in lobe 300. A bottom wall defining compartment 298 includes a pivot hole 308. Two limiting blocks 304 are formed on the side of body 296 along a periphery of pivot hole 308. Each limiting block 304 includes an end 306. Furthermore, each limiting block 304 has a height to the side of body 296 smaller or equal to a depth of compartment 298. A housing 282 slightly larger than body 296 is mounted to the side of body 296 to cover compartment 298. Housing 282 includes an axial hole 284 aligned with pivot hole 308.

According to the preferred form shown, returning device 28 further includes a substantially cylindrical rotatable member 280 having flange 288 on an intermediate portion of an outer periphery thereof. Two pivotal sections 290 are formed on opposite sides of flange 288. Also formed on the outer periphery of rotatable member 280 are first and second blocks 286 adjacent two ends of flange 288. A slit 294 is formed between flange 288 and first block 286. Rotatable member 280 further includes a non-circular hole 292 through which engaging portion 244 of handle 24 extends. Pivotal sections 290 are respectively and pivotably received in pivot hole 308 of body 296 and axial hole 284 of housing 282 with blocks 286 located between limiting blocks 304. The spacing between limiting blocks 304 and blocks 286 limits rotation of rotatable member 280.

According to the preferred form shown, returning device 28 further includes an elastic element 312 in the form of a spiral spring having a spiral section, a first, outer tang 314 outside of the spiral section, and a second, inner tang 316 inside of the spiral section. The spiral section of elastic element 312 is mounted around limiting blocks 304 and located in compartment 298 with first, outer tang 314 abutting against a wall of engaging groove 302 and with second, inner tang 316 received in slit 294 of rotatable member 280 and abutting against a side of first block 286 adjacent slit 294. Thus, first tang 314 is fixed to body 296, and second tang 316 is fixed in slit 294. Rotatable member 280 is biased by elastic element 312 so that each of first and second blocks 286 presses against end 306 of one of limiting blocks 304. In this state, stem 240 of handle 24 is in a horizontal state with rotatable member 280 in its initial position. When rotatable member 280 is rotated, first block 286 adjacent slit 294 presses against second tang 316 of elastic element 312 to store the restoring force.

Returning device 28 is received in opening 462 of inner lid 46 and abuts against bend 466. Lobe 300 is received in second groove 219, such that returning device 28 can not rotate. Engaging portion 244 of handle 24 is extended through non-circular hole 292 of rotatable member 280. A fastener 250 is threadedly engaged in a screw hole in an end face of engaging portion 244 and includes a head abutting against rotatable member 280, such that returning device 28 can not move along engaging portion 244. Thus, follower 38 and actuating member 36 are retained in place. Due to non-circular coupling between engaging portion 244 and rotatable member 280, elastic element 312 is twisted by rotatable member 280 when handle 24 is rotated. When handle 24 is released, elastic element 312 returns rotatable member 280 to its initial position and returns handle 24 to its initial, horizontal position. Limiting blocks 304 limit rotational movement of handle 24 to be about 45° in either direction. According to the preferred form shown, handle 24 can rotate 45° in a counterclockwise direction.

According to the preferred form shown, outer operational device 2 further includes a limiting member 32 including a substantially triangular pivotal portion 320. Pivotal portion 320 includes first and second limiting portions 322 and 336 with a groove 338 formed between first and second limiting portions 322 and 336. A stop 324 is formed on a side of pivotal portion 320. Stop 324 has a positioning hole 328 in a face thereof. Stop 324 further includes an arcuate stop face 334 facing first limiting portion 322. Further, stop 324 includes a substantially Y-shaped follower portion 326 on an upper end thereof. Follower portion 326 includes first and second protruded portion 330 and 332.

According to the preferred form shown, outer operational device 2 further includes first and second guide pins 346 and 347 mounted in upper and lower fixing holes 210 of cover 20. Pivotal portion 320 of limiting member 32 is pivotably mounted around second guide pin 347. First guide pin 346 is slideably received in groove 338 between first and second limiting portions 322 and 336. A spring 354 includes a first tang 356 received in positioning hole 212 of cover 20 and a second tang 358 received in positioning hole 328 of stop 324. Limiting member 32 is positioned by resiliency of spring 354.

Figure 11:
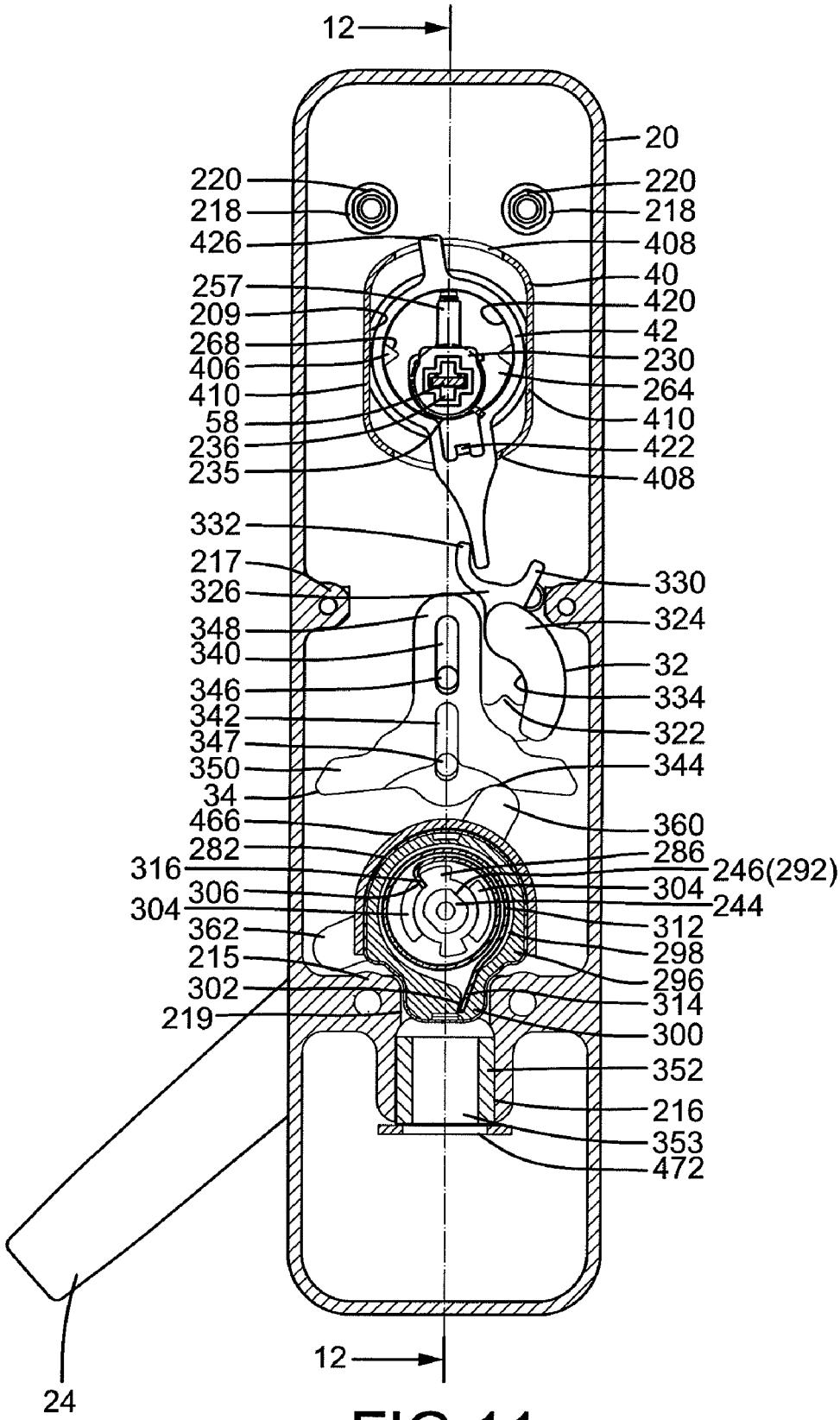
FIG. 11 is a view similar to FIG. 5 with a handle operated for unlatching purposes.
Figure 12:
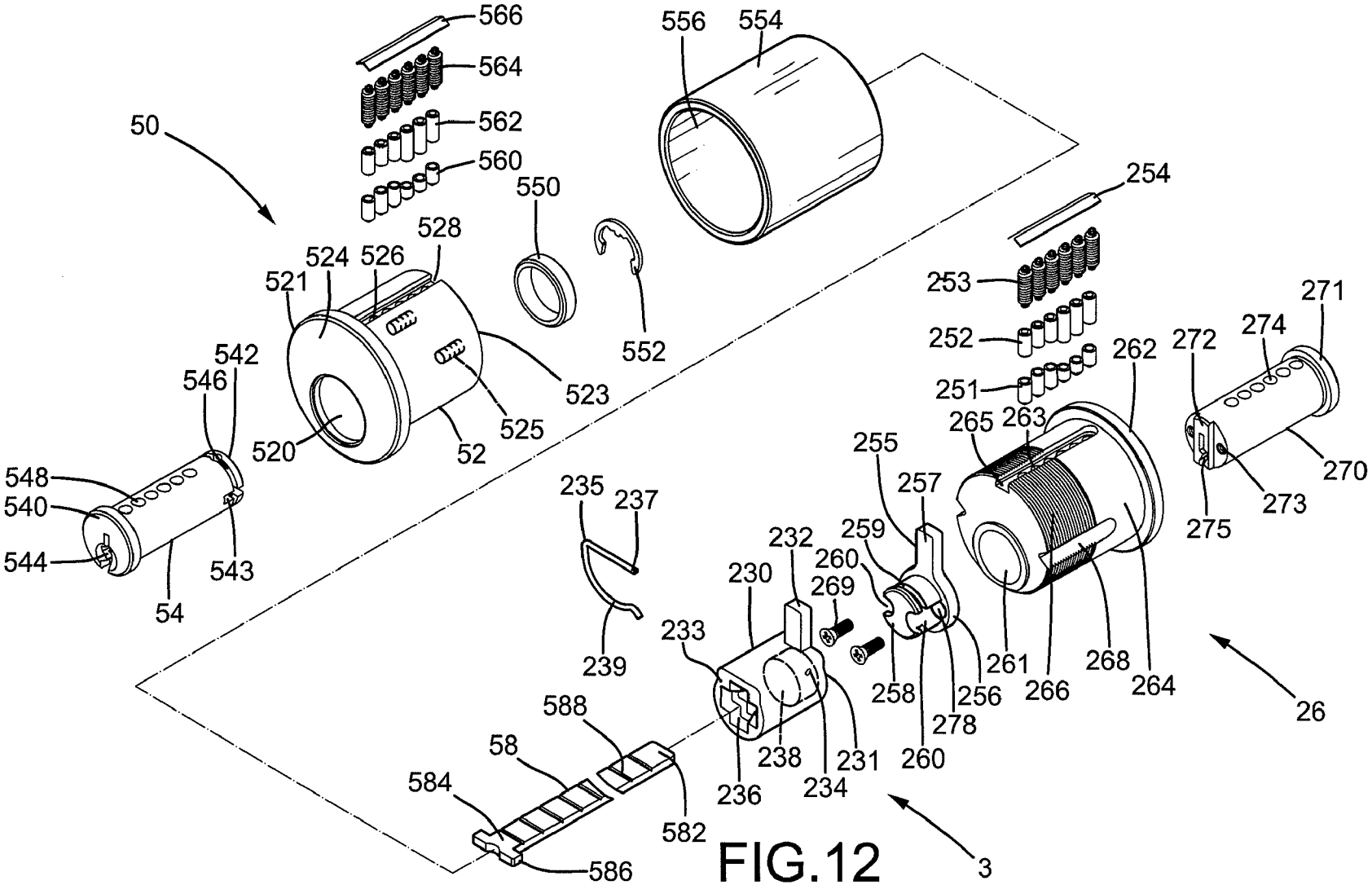
FIG. 12 shows an exploded perspective view of a locking mechanism and an outer cylinder of the panic exit door lock of FIG. 1.

According to the preferred form shown, outer operational device 2 further includes a substantially T-shaped sliding member 34 having a vertical, first section 348 and a substantially horizontal, second section 350. First section 348 includes a first guiding groove 340 and a second guide groove 342 below first guiding groove 340. Each of first and second guiding grooves 340 and 342 has a length substantially the same as that of elongated slots 460 of inner lid 46. Second section 350 includes a connecting portion 341 having two pegs 349 each having a screw hole. Furthermore, second section 350 includes a pressing face 344 at a lower end thereof. Sliding member 34 is slideably received in space 200 of cover 20 with pressing face 344 abutting against first and second ends 360 and 362 of actuating member 36. First guide pin 346 is extended through first guiding groove 340, and second guide pin 347 is extended through second guiding groove 342, so that limiting member 34 can only slide through the length of first and second guiding grooves 340 and 342 in the vertical direction. Pegs 349 of connecting portion 341 are extended into elongated slots 460 of inner lid 40. Provision of first and second guiding grooves 340 and 342 prevent rotation of sliding member 34 during sliding movement. When rotatable member 280 rotates to a position abutting against the other limiting block 304, actuating member 36 rotates, and one of first and second ends 360 and 362 (depending on the rotating direction of actuating member 36) pushes sliding member 34 upward to an upper position (FIG. 11). When first and second ends 360 and 362 of actuating member 36 are at the same level, sliding member 34 is in its lower position.

According to the preferred form shown, outer operational device 2 further includes a substantially T-shaped driving member 44 having a base portion 440 extending in the vertical direction and a rod 442 extending horizontally from an intermediate section of base portion 440. An upper end of base portion 440 is bent to form an engaging portion 448. A lower end of base portion 44 includes a guiding portion 444 that has a shape corresponding to sliding groove 353 of guide block 352 and that is aligned with connecting portion 341 of sliding member 34. Two fasteners 446 are extended through holes in engaging portion 448 and elongated slots 460 of inner lid 46 into the screw holes of pegs 349 of connecting portion 341 of sliding member 34. Guiding portion 444 is extended into sliding groove 353 of guide block 35. Thus, driving member 44 and sliding member 34 can move jointly. Elongated slots 460 of inner lid 46 allow movement of fasteners 446. Sliding groove 353 allows stable sliding of guiding portion 444 when rod 442 is subjected to a torque. Rod 442 extends through mounting hole 106 of door 10 and base 130 to a position below a lower one of slides 142.

According to the preferred form shown, outer operational device 2 further includes an outer cylinder 26 including a cylindrical outer cylinder body 264 having a flange 262 on an end face thereof. Outer cylinder body 264 includes an eccentric bore 261 extending in a longitudinal direction along an axis parallel to and spaced from a central, longitudinal axis of outer cylinder body 264. An end of an outer periphery of outer cylinder body 264 includes a threaded portion 266. The outer periphery of outer cylinder body 264 further includes two diametrically opposed V-shaped positioning grooves 268. The outer periphery of outer cylinder body 264 further includes a longitudinal groove 265 extending in the longitudinal direction and parallel to and spaced from bore 261. Longitudinal groove 265 is spaced from each positioning groove 268 by 90° in the most preferred form shown. A plurality of upper tumbler pin holes 263 extend from a bottom wall of longitudinal groove 265 to bore 261 and are spaced in the longitudinal direction.

According to the preferred form shown, an outer lock core 270 is received in outer cylinder body 264 and includes an enlarged head 271 on an end thereof and a tail 272 on the other end thereof, with tail 272 having a diameter smaller than that of enlarged head 271. Outer lock core 270 further includes a keyway 275 extending from head 271 through tail 272. Outer lock core 270 further includes a plurality of lower tumbler pin holes 274 in an outer periphery thereof and spaced in the longitudinal direction. Each lower tumbler pin hole 274 extends from the outer periphery of outer lock core 270 to keyway 275. Two screw holes 273 are provided in an end face of tail 272. Outer lock core 270 is rotatably received in bore 261 of outer cylinder body 264 with tail 272 outside of bore 261 and with head 271 abutting an end of bore 261, such that each lower tumbler pin hole 274 is aligned with one of upper tumbler pin holes 263.

According to the preferred form shown, an actuating block 255 is mounted to tail 272 of outer lock core 270. Specifically, actuating block 255 includes a main portion 256 having an ear 257 extending radially outward from an outer periphery of main portion 256. A coupling portion 258 extends from a side of main portion 256 and includes an annular groove 259 in the outer periphery thereof. In the most preferred form shown, coupling portion 258 includes two diametrically opposed, longitudinal grooves 260, and main portion 256 includes two through-holes 278 aligned with grooves 260. Two fasteners 269 are received in grooves 260 and extended through through-holes 278 into screw holes 273 of outer lock core 270, so that actuating block 255 and outer lock core 270 can rotate jointly about the axis of bore 261. Actuating block 255 prevents outer lock core 270 from disengaging from outer cylinder 26 through movement along the axis of bore 261.

According to the preferred form shown, a lower tumbler pin 251, an upper tumbler pin 252, and a spring 253 are received in each pair of aligned upper and lower tumbler pin holes 263 and 274. A lid 254 is mounted in longitudinal groove 265 to prevent disengagement of upper and lower tumbler pins 252 and 251 and springs 253. Each spring 253 includes a first end pressing against lid 254 and a second end pressing against one of upper tumbler pins 252, assuring reliable contact between a pair of aligned upper and lower tumbler pins 252 and 251 and assuring lower tumbler pin 251 extending into keyway 275. Furthermore, each upper tumbler pin 252 normally extends into one of lower tumbler pin holes 274. Thus, outer lock core 270 can not rotate in bore 261 without a key 60. Upper tumbler pins 252 have differing lengths, and lower tumbler pins 251 have differing lengths, providing numerous combinations of keys.

According to the preferred form shown, outer cylinder 26 is received in compartment 206 of cover 20 with flange 262 abutting a bottom wall of compartment 206. Outer cylinder body 264 is extended through opening 208 into mounting hole 106 of door 10.

According to the preferred form shown, outer operational device 2 further includes a mover 42 having a circular hole 420. Mover 42 includes a limiting bar 426 extending upward from an upper end thereof and an actuating bar 424 extending downward from a lower end thereof. A tab 422 extends perpendicularly from actuating bar 424. Mover 42 is rotatably mounted around outer cylinder body 264.

According to the preferred form shown, the outer operational device further includes a lid 40 in the form of a thin shell. Specifically, lid 40 includes two lateral walls 410 and an interconnecting wall 412 interconnected between lateral walls 410. A hole 402 is defined in interconnecting wall 412 and has a shape corresponding to body 264 of cylinder 26. Two diametrically opposed projections 406 are formed on an inner periphery of hole 402. Interconnecting wall 412 further includes an arcuate limiting groove 404 below hole 402. Lid 40 further includes an upper notch 408 in a top thereof between upper ends of lateral walls 410 and a lower notch 408 in a bottom thereof between lower ends of lateral walls 410. Lid 40 is mounted around outer cylinder body 264 of outer cylinder 26 with projections 406 engaged in positioning grooves 268 and with lateral walls 410 abutting chamfered faces 209 of receiving portion 205, so that outer cylinder 26 can not rotate and that lid 40 can not rotate relative to receiving portion 205. A washer 276 with inner threading is threadedly engaged around threaded portion 266 and abuts a face of interconnecting wall 412 of lid 40, preventing lid 40 from moving along the longitudinal direction of outer cylinder body 264. Furthermore, mover 42 is rotatably mounted between cover 20 and washer 276.

Limiting bar 426 of mover 42 extends beyond upper notch 408 of lid 40, and actuating bar 424 extends beyond lower notch 408 of lid 40. Furthermore, tab 422 of mover 42 extends beyond limiting groove 404 of lid 40. Thus, rotational movement of mover 42 is limited by notches 408 and limiting groove 404. Actuating bar 424 is located between first and second protruded portions 330 and 332 of limiting member 32. Tab 422 is located in a path of rotational movement of actuating block 255, so that mover 42 rotates when actuating block 255 comes in contact with and drives tab 422.

According to the preferred form shown, locking mechanism 3 includes an inner cylinder 50 including inner cylinder body 52 having front and rear end faces 521 and 523 and an eccentric bore 520 extending from front end face 521 through rear end face 523 in the longitudinal direction along an axis parallel to and spaced from a central, longitudinal axis of inner cylinder body 52. A flange 524 is formed on front end face 521. Two screw holes 525 are formed in rear end face 523. Inner cylinder body 52 further includes a longitudinal groove 528 in an outer periphery thereof. Longitudinal groove 528 extends in the longitudinal direction and parallel to and spaced from bore 520. A plurality of upper tumbler pin holes 526 extend from a bottom wall of longitudinal groove 528 to bore 520 and are spaced in the longitudinal direction. An inner lock core 54 is received in bore 520 and includes an enlarged head 540 on an end thereof and a tail 542 on the other end thereof, with tail 542 having a diameter smaller than that of enlarged head 540. Tail 542 includes an annular groove 546 in an outer periphery thereof. Tail 542 further includes a groove 543 extending from an end face of tail 543 towards but spaced from head 540 in the longitudinal direction and intersecting and in communication with annular groove 546. Inner lock core 54 further includes a keyway 544 extending from head 540 through tail 542. Inner lock core 54 further includes a plurality of lower tumbler pin holes 548 in the outer periphery thereof and spaced in the longitudinal direction. Each lower tumbler pin hole 548 extends from the outer periphery of inner lock core 54 to keyway 544. Inner lock core 54 is rotatably received in bore 520 of inner cylinder body 52 with tail 542 outside of bore 520 and with head 540 abutting an end of bore 520, such that each lower tumbler pin hole 548 is aligned with one of upper tumbler pin holes 526.

According to the preferred form shown, a lower tumbler pin 560, an upper tumbler pin 562, and a spring 564 are received in each pair of aligned upper and lower tumbler pin holes 526 and 548. A lid 566 is mounted in longitudinal groove 528 to prevent disengagement of upper and lower tumbler pins 562 and 560 and springs 564. Each spring 564 includes a first end pressing against lid 566 and a second end pressing against one of upper tumbler pins 562, assuring reliable contact between a pair of aligned upper and lower tumbler pins 562 and 560 and assuring lower tumbler pin 560 extending into keyway 544. Furthermore, each upper tumbler pin 562 normally extends into one of lower tumbler pin holes 548. Thus, inner lock core 540 can not rotate in bore 520 without a key 60. Upper tumbler pins 562 have differing lengths, and lower tumbler pins 560 have differing lengths, providing numerous combinations of keys.

According to the preferred form shown, locking mechanism 3 further includes a tongue 58 having front and rear ends 582 and 584 spaced in the longitudinal direction. Rear end 584 includes an ear 586 on each of two sides thereof. Each ear 586 has a width slightly smaller than a diameter of tail 542 of inner lock core 54. Tongue 58 includes an upper face with a plurality of slots 588 spaced at regular intervals between front and rear ends 582 and 584. Ears 586 of rear end 584 are received in groove 543 of inner lock core 54. A positioning ring 550 is mounted around inner lock core 54 between groove 543 and lower tumbler pin holes 548. A retainer ring 552 is engaged in annular groove 546 of inner lock core 54 to position positioning ring 550 between retainer ring 552 and rear end face 523 of inner cylinder body 52. Positioning ring 550 prevents ears 586 of tongue 58 from extending out of groove 543 of inner lock core 54. Retainer ring 552 retains ears 586 of tongue 58 in a position behind annular groove 546, preventing tongue 58 from disengaging from groove 543 of inner lock core 54. Thus, tongue 58 is reliably fixed to inner lock core 54.

Figure 13:
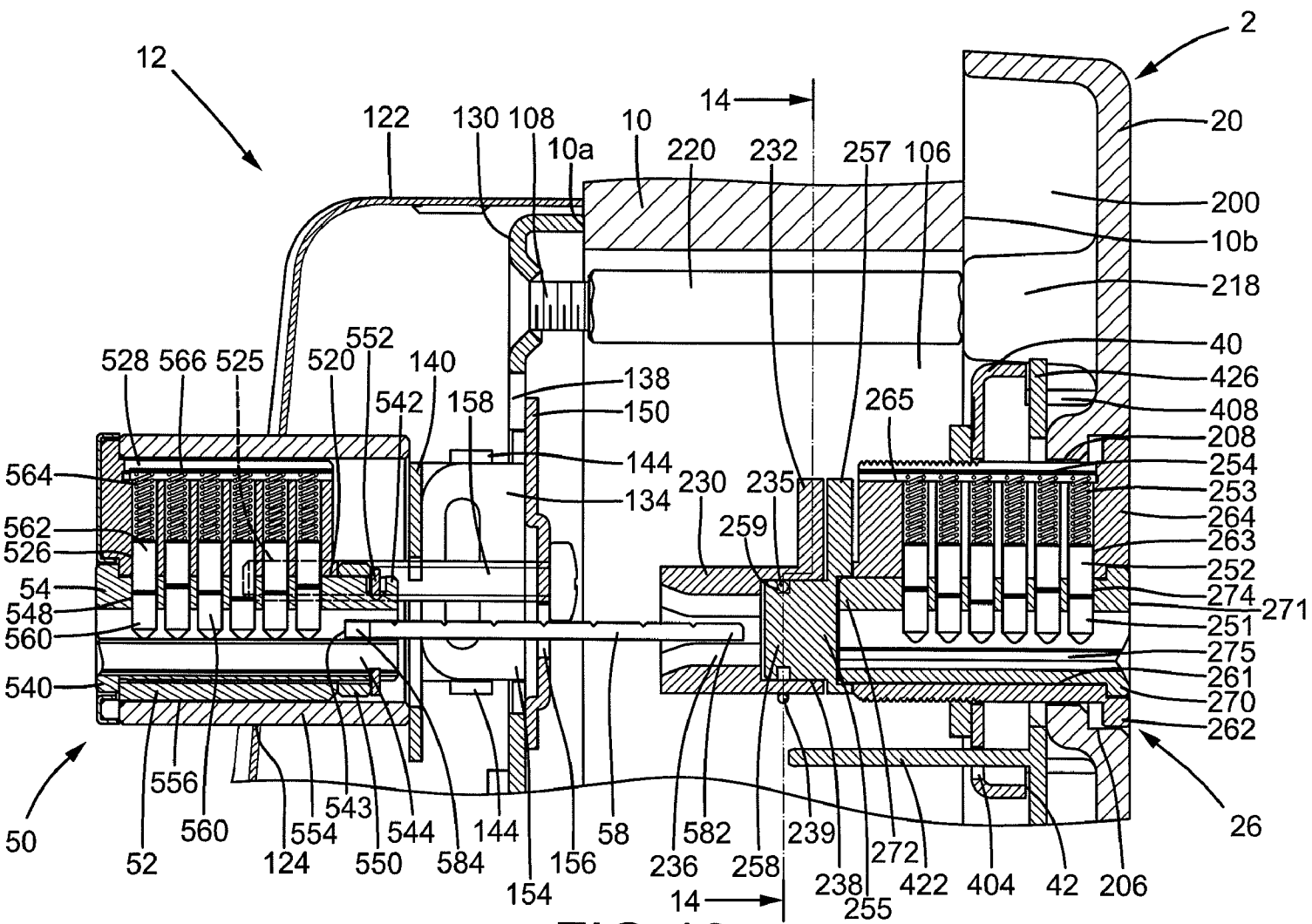
FIG. 13 shows a cross sectional view of the locking mechanism and the outer cylinder of FIG. 12 according tot section line 13-13 of FIG. 3.
Figure 14:
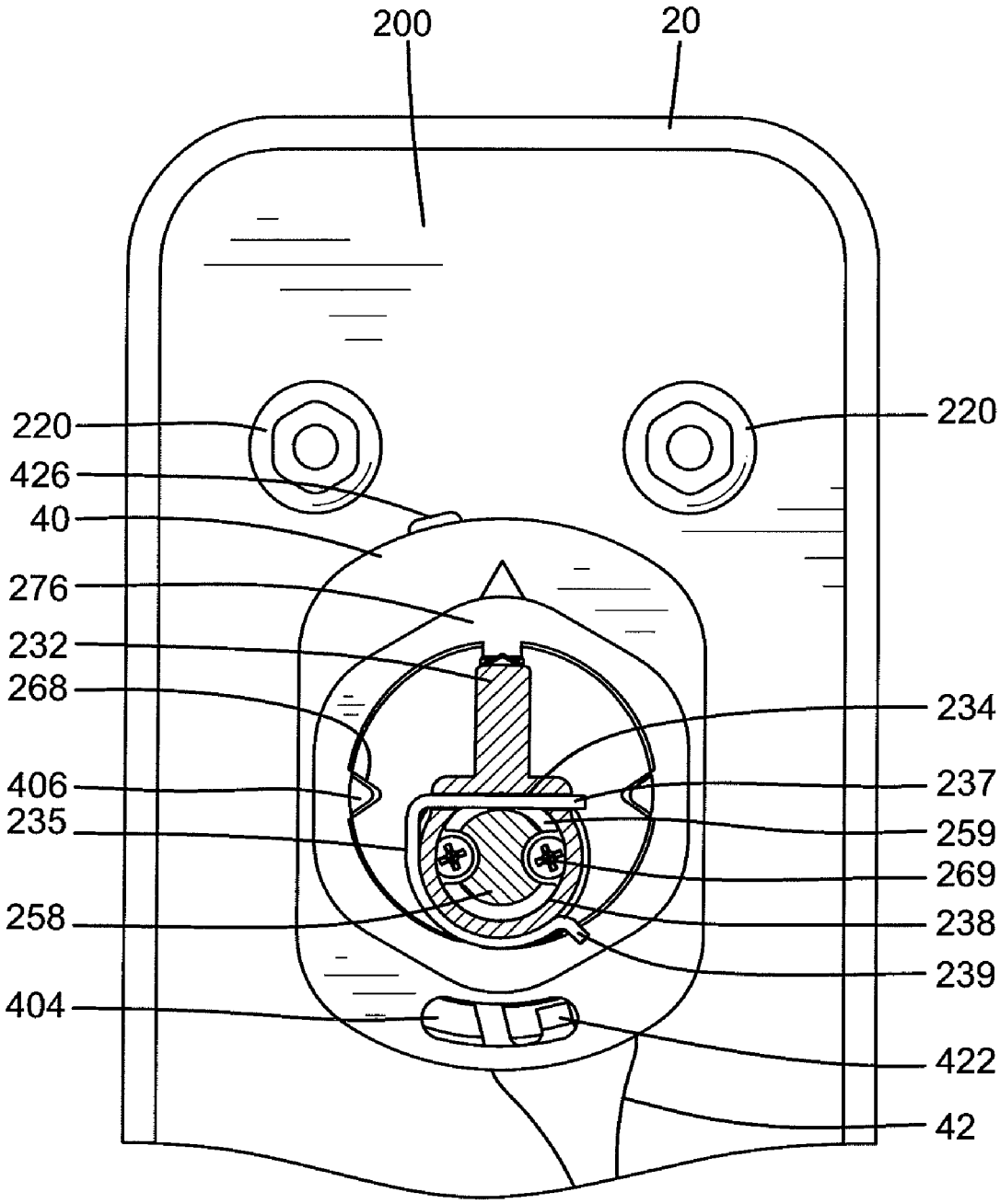
FIG. 14 shows a partial, cross sectional view according to section line 14-14 of FIG. 13.

According to the preferred form shown, locking mechanism 3 further includes an outer sleeve 554 having a longitudinal sleeve hole 556 receiving inner lock core body 52. Flange 524 of inner lock core body 52 abuts an end face of outer sleeve 554, and tongue 58 extends beyond outer sleeve 554. With reference to FIGS. 1 and 13, inner cylinder 50 is fixed by a connecting board 140 and a locking plate 150 to upper guiding mechanism 132 of base 130. Connecting board 140 is made of a thin metal plate and includes a first hole 146 in a center thereof. Two second holes 148 are defined in a periphery defining first hole 146. Connecting plate 140 further includes two lateral sides 142 each having a restraining portion 144 extending inward from each of upper and lower ends thereof. A spacing between a pair of aligned upper and lower upper restraining portions 144 is generally equal to a length of each tab 134 in the vertical direction. Connecting board 140 is mounted to tabs 134, with lateral sides 142 aligned with tabs 134, with two upper restraining portions 144 abutting upper ends of tabs 134, and with two lower restraining portions 144 abutting lower ends of tabs 134. Thus, connecting board 140 can not move relative to tabs 134 in the vertical direction and in a transverse direction perpendicular to the vertical direction.

Figure 3:
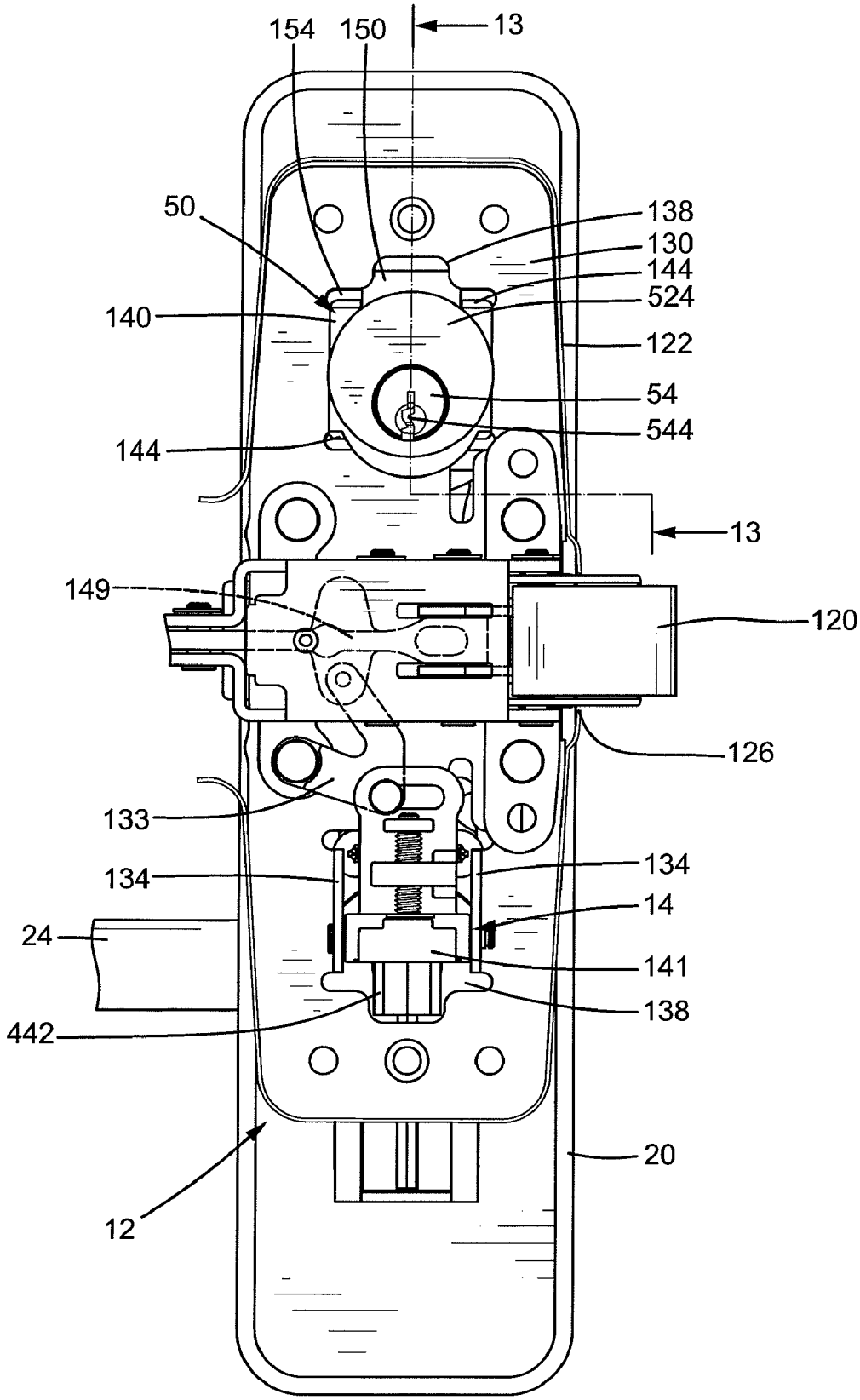
FIG. 3 shows a side view of the panic exit door lock of FIG. 1.
Figure 4:
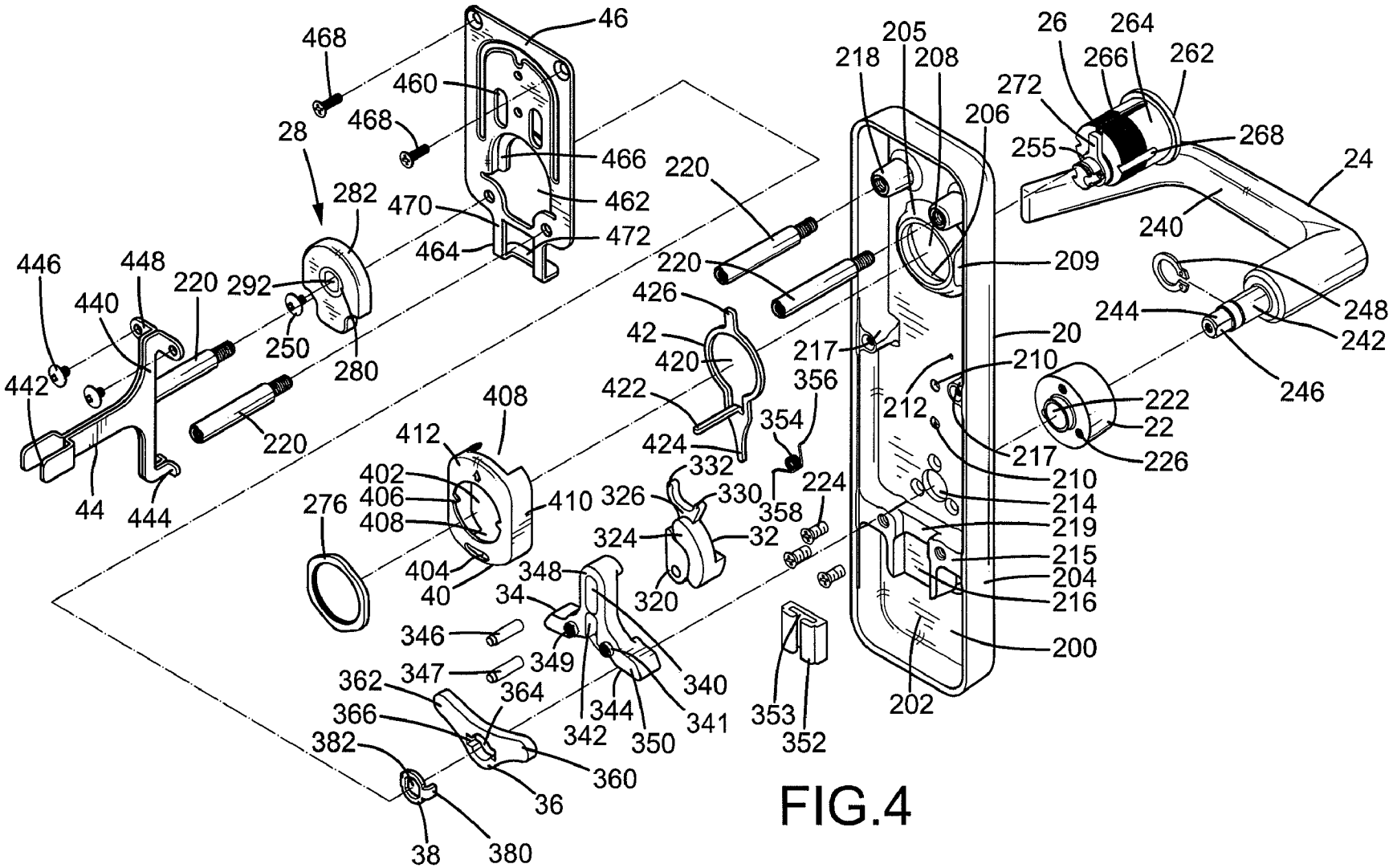
FIG. 4 shows an exploded, perspective view of an outer operational device of the panic exit door lock of FIG. 1.

According to the preferred form shown, locking plate 150 is mounted to the other side of base 130 and aligned with upper guiding mechanism 132. Specifically, locking plate 150 includes two holes 152 aligned with second holes 148 of connecting board 140. Locking plate 150 further includes a through-hole 156 between holes 152. Furthermore, locking plate 150 includes a plurality of protrusions 154 in the most preferred form shown formed in four corners of locking plate 150. Protrusions 154 are inserted into four corners of slot 138 of upper guiding mechanism 132 to position locking plate 150 (FIG. 3). The other end face of outer sleeve 554 abuts a face of connecting board 140 with screw holes 525 aligned with second holes 148. Two screws 158 are extended through holes 152 of locking plate 150 and second holes 148 of connecting board 140 into screw holes 525 of inner cylinder body 52. Thus, inner cylinder 50, connecting board 140, and locking plate 150 are fixed to upper guiding mechanism 132, with tongue 58 extending through first hole 146 of connecting board 140 and through-hole 156 of locking plate 150.

According to the preferred form shown, locking mechanism 3 further includes a driving block 230 having first and second ends 231 and 233. First end 231 of driving block 230 includes a circular receptacle 238. A lug 232 extends radially outward from an outer periphery of first end 231 of driving block 230. A radial engaging hole 234 extends from the outer periphery of driving block 230 to receptacle 238. Second end 233 of driving block 230 includes a non-circular coupling hole 236 that is cruciform in cross section in the most preferred form shown. Receptacle 238 receives coupling portion 258 of actuating block 255, with radial engaging hole 234 aligned with groove 259.

According to the preferred form shown, locking mechanism 3 further includes a substantially V-shaped resilient clip 235 having first and second ends 237 and 239. First end 237 of resilient clip 235 extends through radial engaging hole 234 of driving block 230 into groove 259 of actuating block 255. Second end 239 of resilient clip 235 abuts the outer periphery of driving block 230, preventing driving block 230 from moving along a longitudinal axis of coupling portion 258 of actuating block 255. However, since groove 259 of actuating block 255 is annular, driving block 230 can rotate about coupling portion 258. Resilient clip 235 can be easily removed when it is desired to disengage driving block (230) from actuating block (255).

Figure 2:
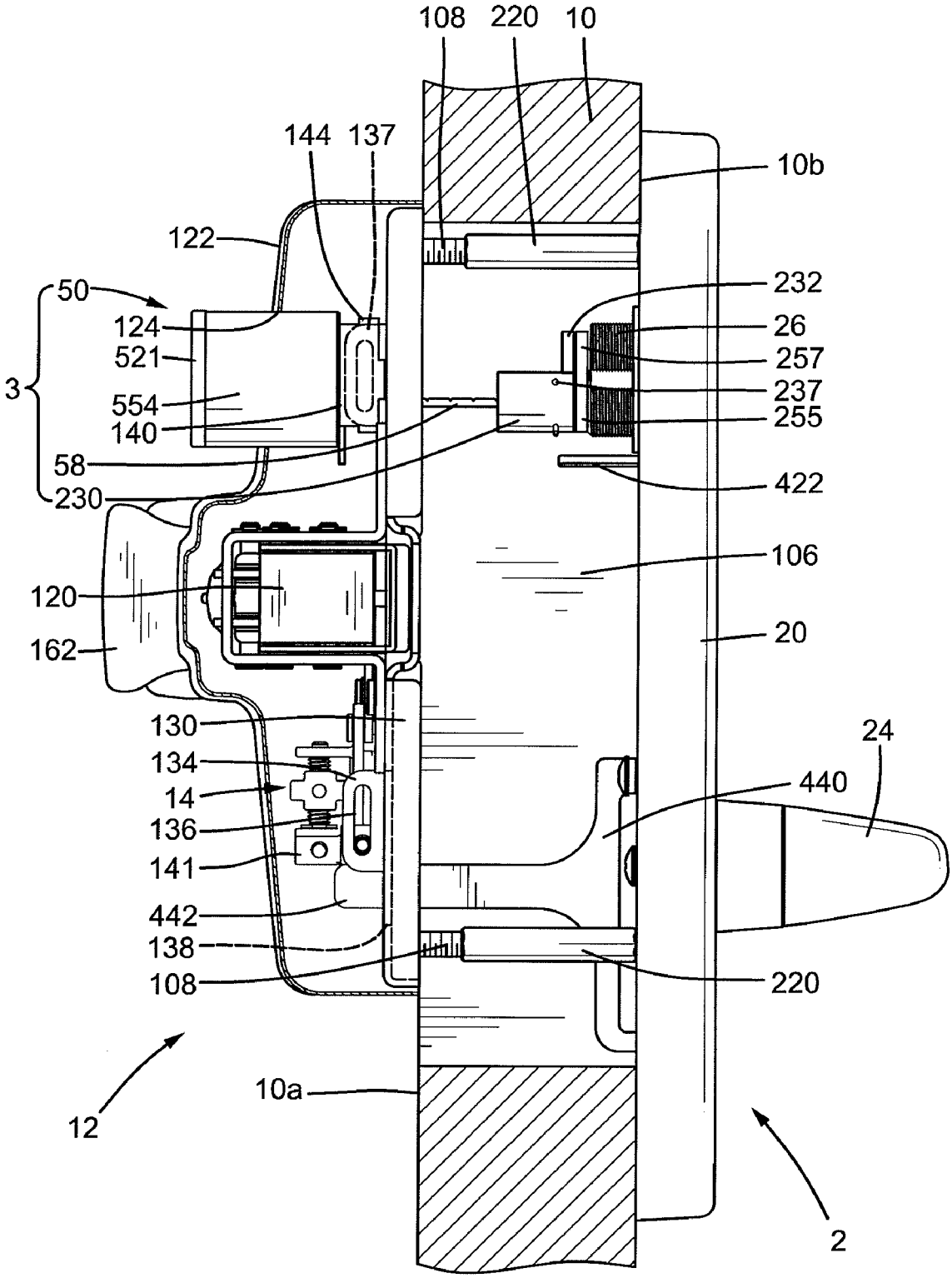
FIG. 2 shows a partial, side elevational view of a panic exit door and the panic exit door lock of FIG. 1.

With reference to FIG. 2, front end 582 of tongue 58 is extended through mounting hole 106 of door 10 into coupling hole 236 of driving block 230. Since coupling hole 236 is non-circular, tongue 58 and driving block 230 rotate jointly. Any one of slots 588 of tongue 58 can be broken to shorten the length of tongue 58 in the longitudinal direction according to the thickness of door 10.

Figure 5:
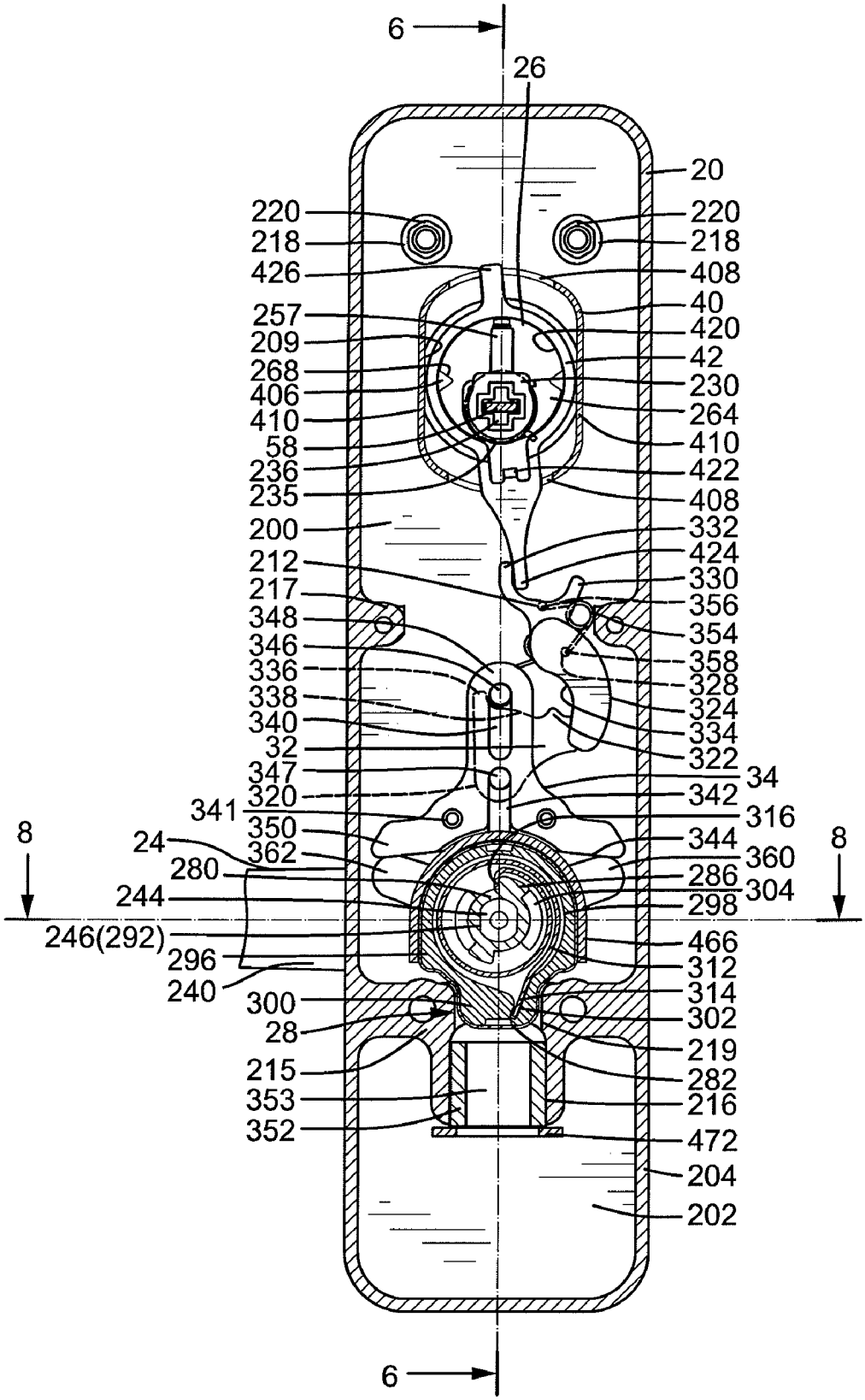
FIG. 5 shows a cross sectional view of the outer operational device of FIG. 4.
Figure 6:
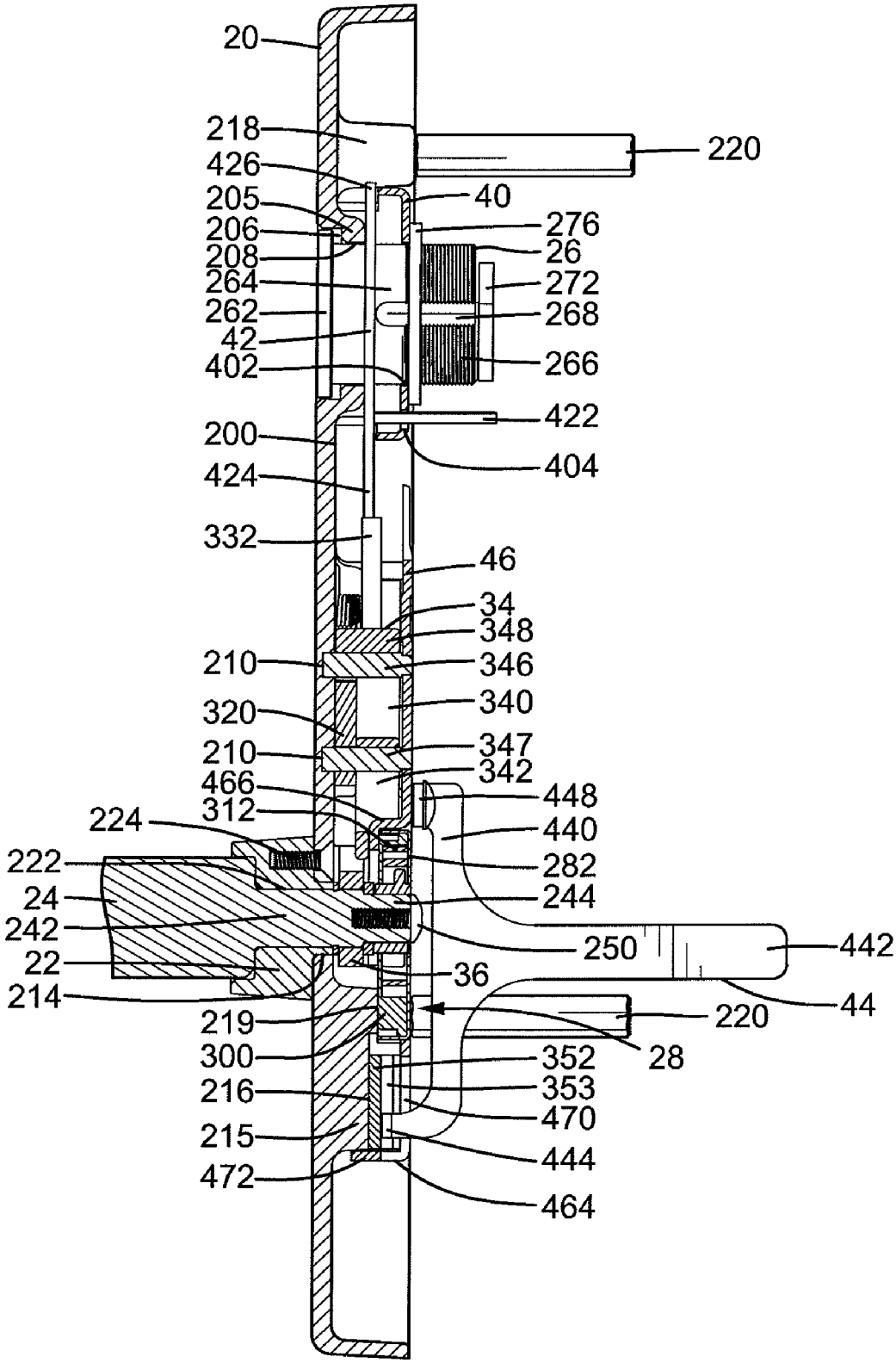
FIG. 6 shows a cross sectional view according to section line 6-6 of FIG. 5.
Figure 7:
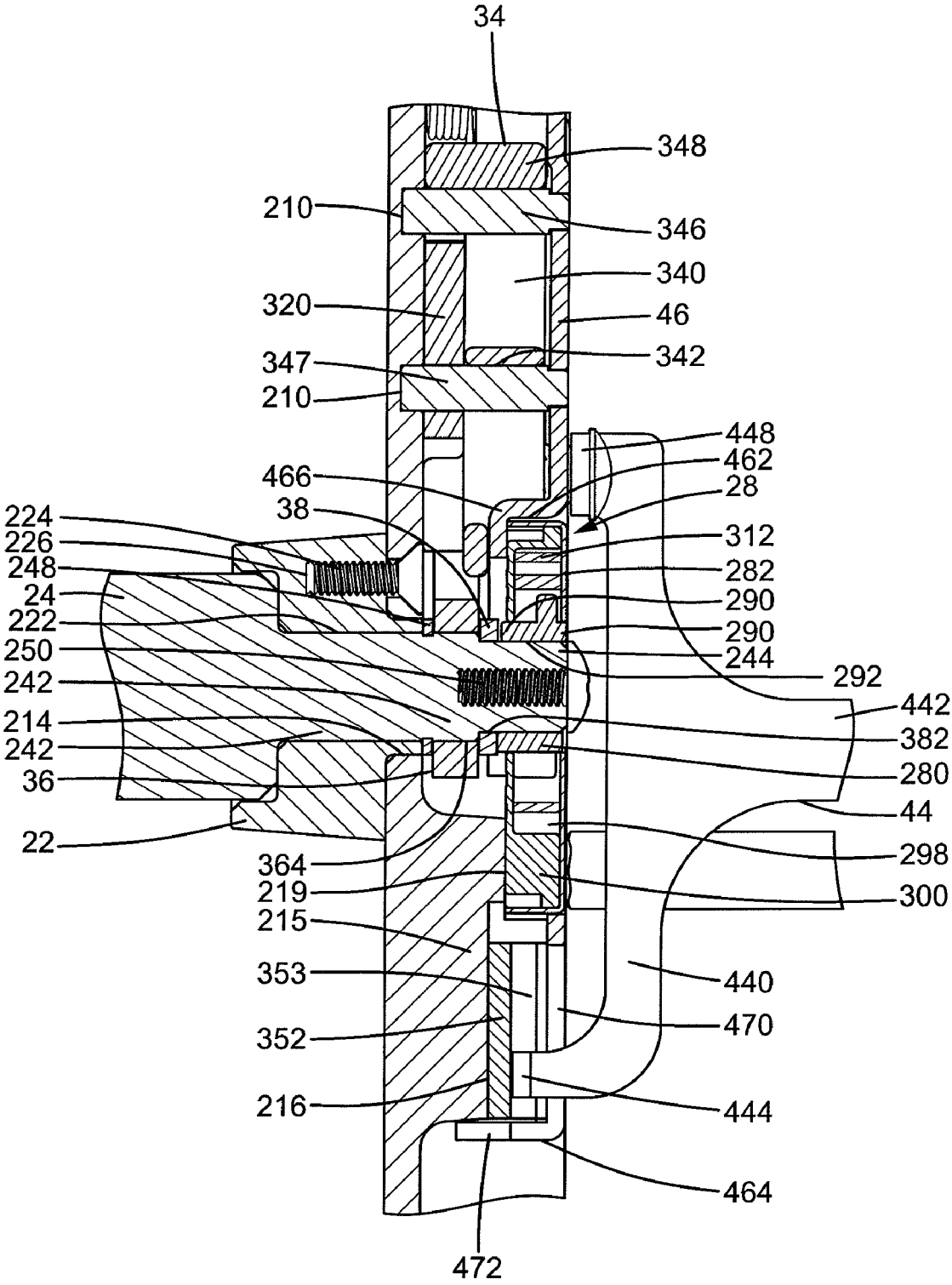
FIG. 7 shows an enlarged view of a portion of the outer operational device of FIG. 6.
Figure 8:
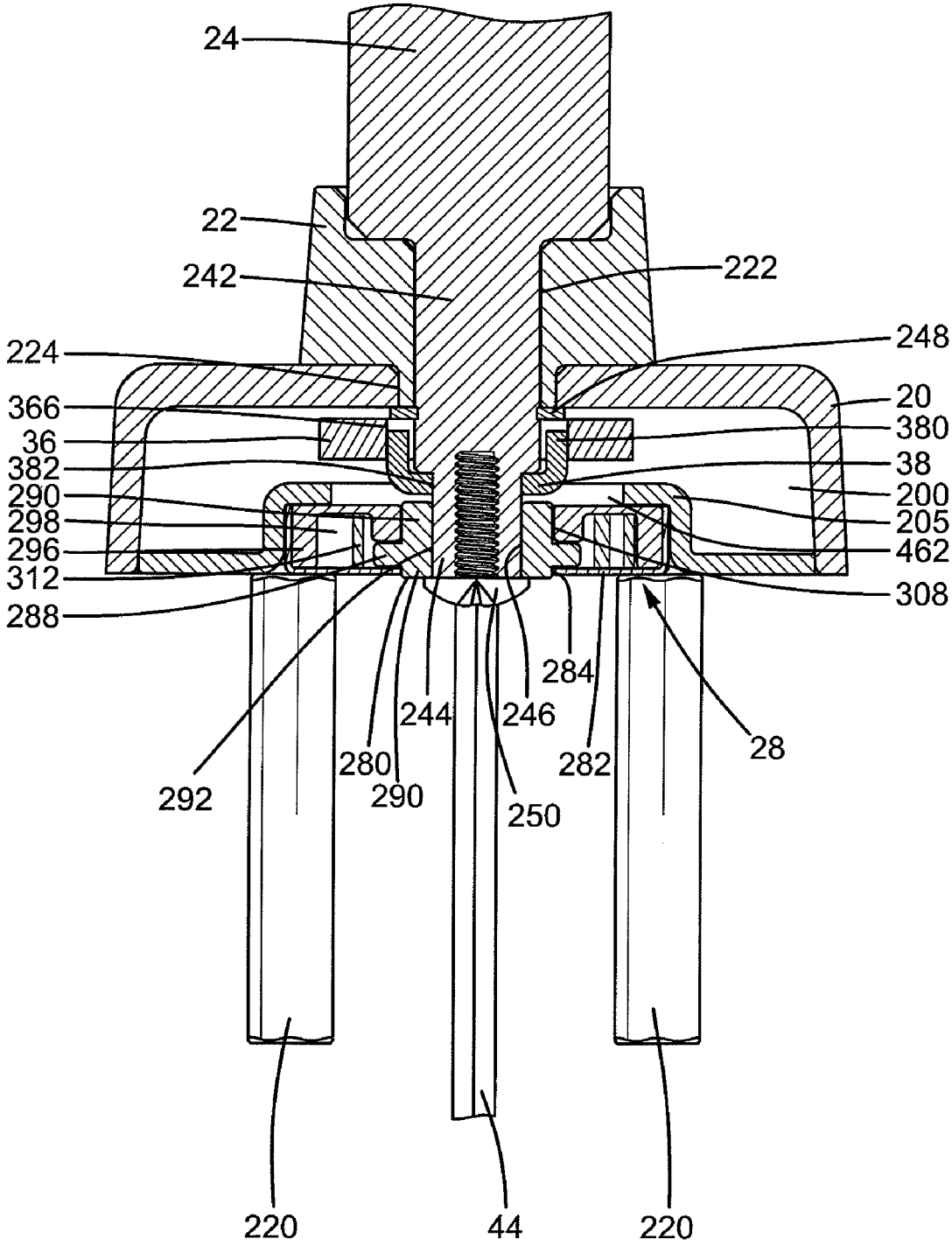
FIG. 8 shows a cross sectional view according to section line 8-8 of FIG. 5.
Figure 9:
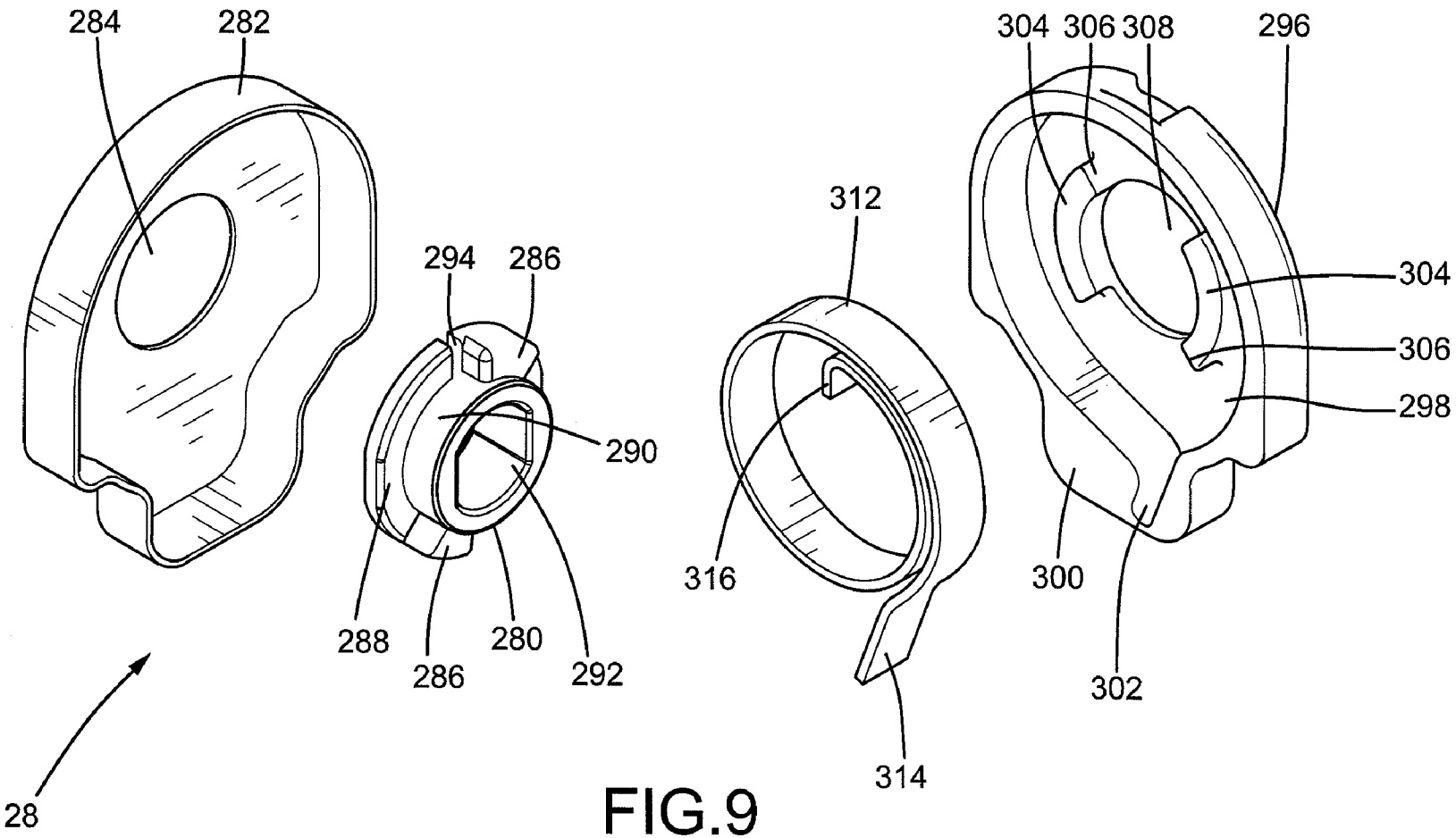
FIG. 9 shows an exploded, perspective view of a returning device of the outer operational device of FIG. 4.
Figure 10:
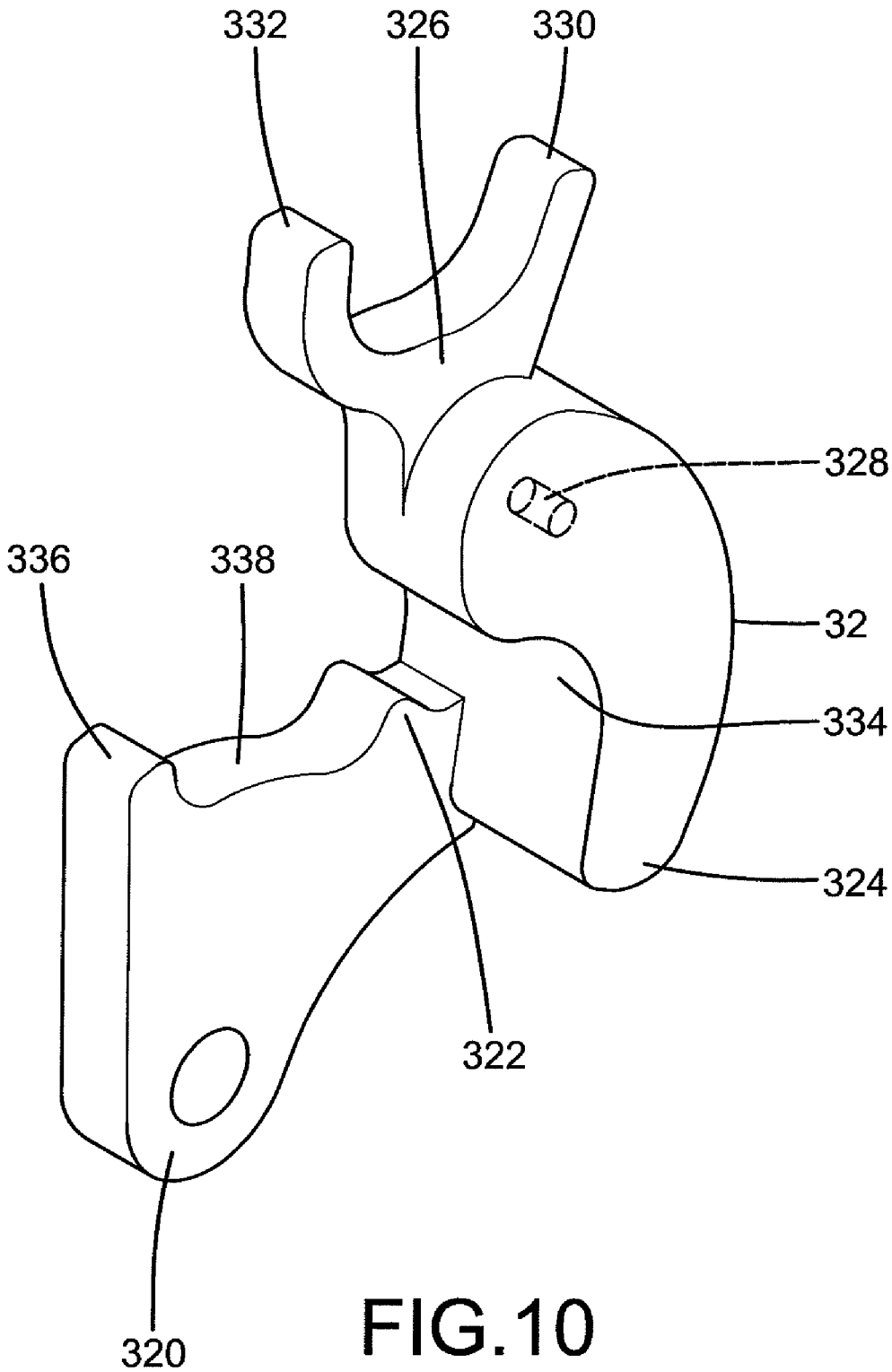
FIG. 10 shows a perspective view of a limiting member of the outer operational device of FIG. 4.

Now that the basic construction of the panic exit door lock of the preferred teachings of the present invention has been explained, the operation and some of the advantages of the outer operational device can be set forth and appreciated. In particular, for the sake of explanation, it will be assumed that handle 24 is in a horizontal position (FIGS. 2, 5, and 6). When handle 24 is rotated, follower 38 and rotatable member 280 of returning device 28 rotate jointly with engaging portion 244, so that first block 286 moves second tang 316 of elastic element 312 and that elastic element 312 is twisted to store potential energy for returning purposes. Actuating member 36 is driven by follower 38 to rotate in a direction (see FIG. 11). When handle 24 is rotated counterclockwise, first end 360 of actuating member 36 rotates upward whereas second end 362 of actuating member 36 rotates downward. First end 360 of actuating member 36 presses against pressing face 344 of sliding member 34, so that sliding member 34 move upward along first and second guide pins 346 and 347. At the same time, driving member 44 is carried upward by sliding member 34. When first block 286 is rotated from its initial position to an extreme position abutting against end 306 of the other limiting block 304, driving member 44 is moved from the lower position to the upper position where stem 240 of handle 24 is at an angle of 45° with the horizontal plane. During movement of driving member 44 from the lower position to the upper position, slide 141 is pressed against and, thus, moved by rod 442 of mover 42, moving latch 120 to the retracted position.

When handle 24 is released after unlocking, second tang 316 of elastic element 312 returns rotatable member 280 from the extreme position back to the initial position, which in turn, rotates handle 24 in a clockwise direction in FIG. 11 to its initial position via engaging portion 244. Thus, stem 240 of handle 24 returns to its horizontal position, and first and second ends 360 and 362 of actuating member 36 are at the same level. At the same time, sliding member 34 moves downward under the action of gravitational force until both first and second ends 360 and 362 of actuating member 36 abut pressing face 344. Furthermore, driving member 44 is carried by sliding member 34 to the lower position. Slide 141 is returned by a returning device to a position shown in FIG. 5.

It can be appreciated that the panic door lock according to the preferred teachings of the present invention can provide a deadlocking function through a setting operation from either outer side 11*b* or inner side 10*a* of door 10. Specifically, when the deadlocking function is not set, limiting member 32 is biased by spring 354 to a release position away from sliding member 34. In this case, second limiting portion 336 abuts against first guide pin 346, actuating bar 424 of mover 42 abuts against second protruded portion 332 of limiting member 32, handle 24 is in the horizontal state, and sliding member 34 is in the lower position.

Figure 15:
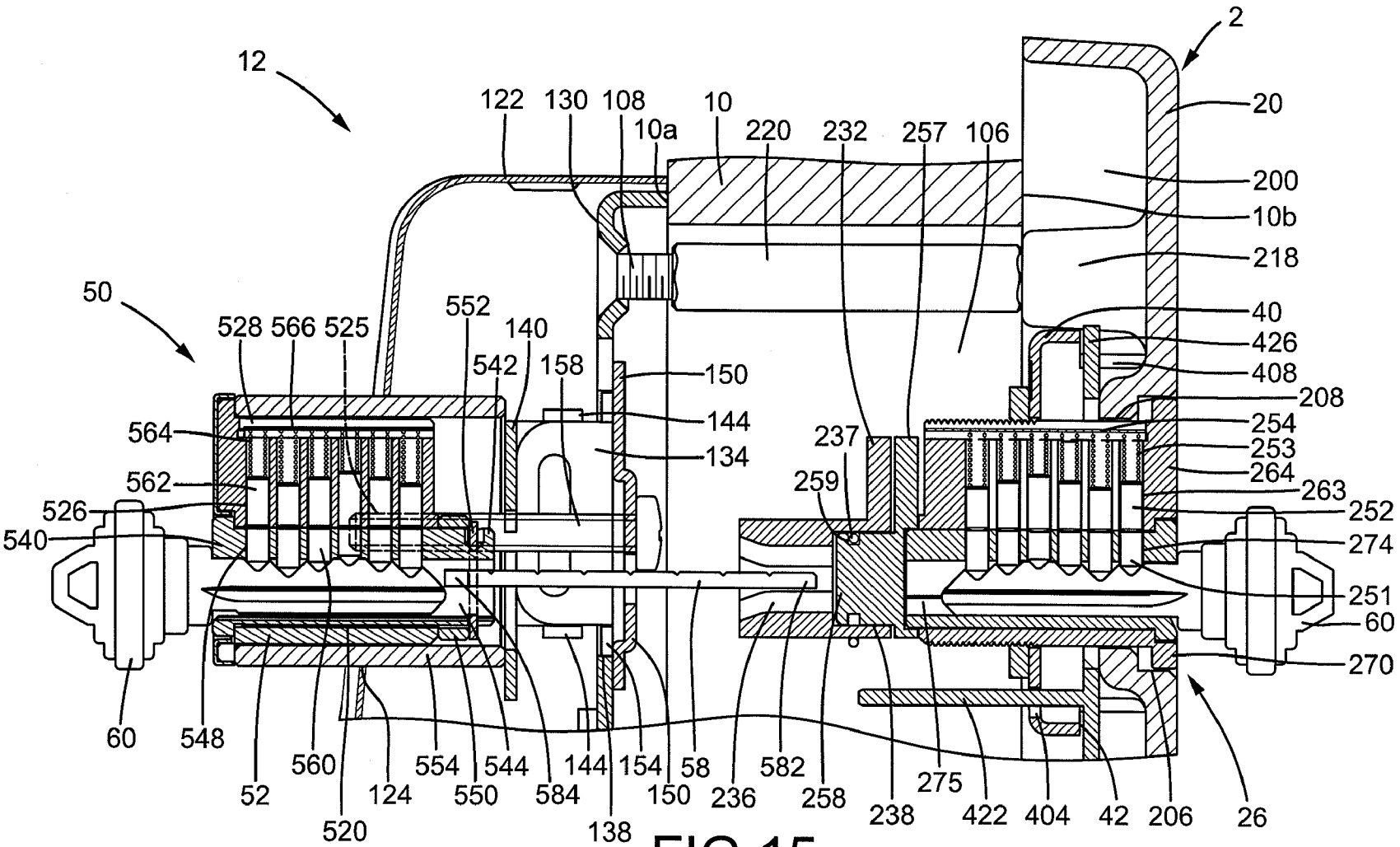
FIG. 15 is a view similar to FIG. 13 with keys inserted into the outer cylinder and an inner cylinder of the locking mechanism.
Figure 16:
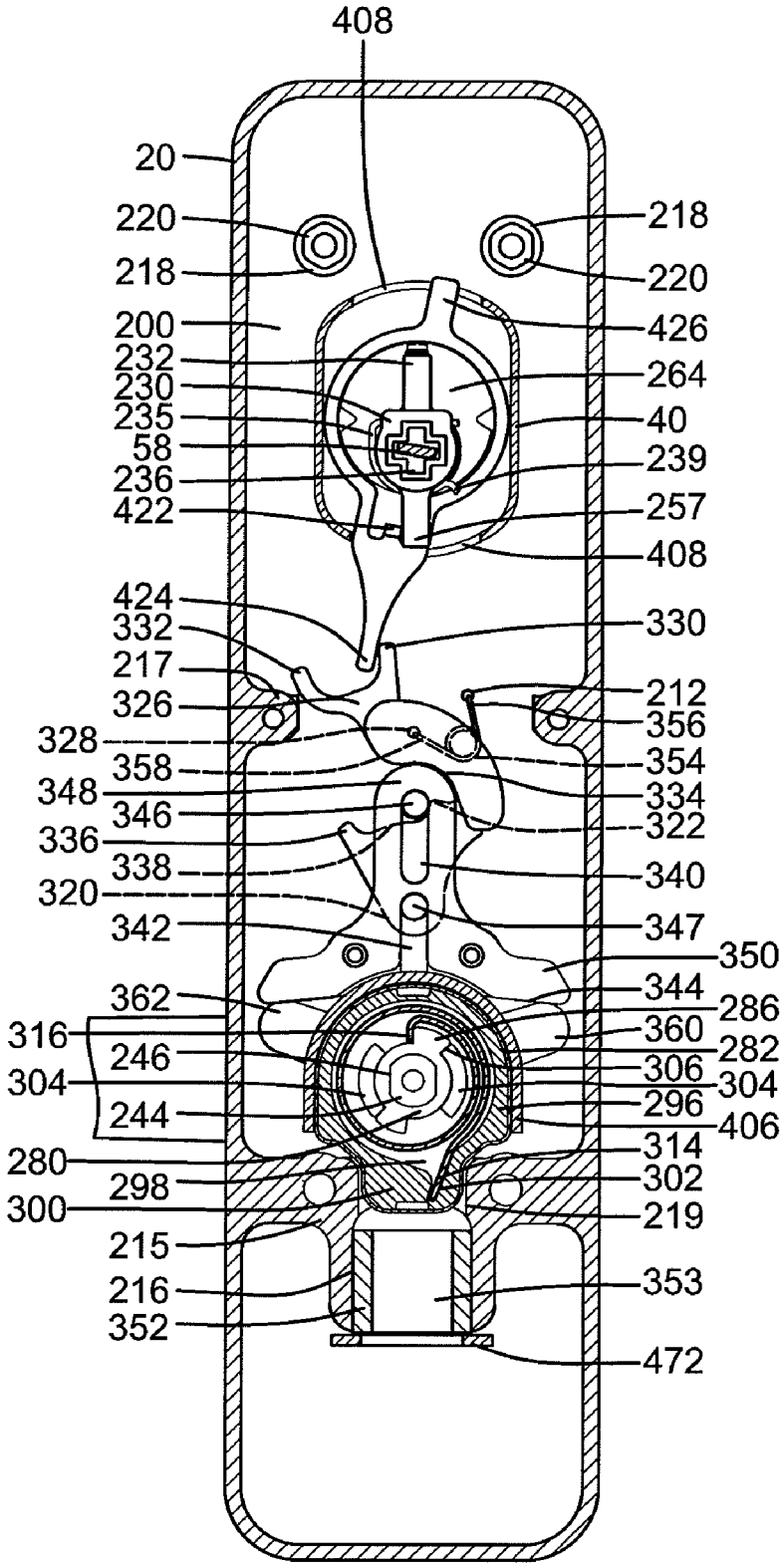
FIG. 16 is a view similar to FIG. 5 with the outer cylinder operated to provide a deadlocking function.

To set the deadlocking function from outer side 10*b* of door, a key 60 (FIG. 15) is inserted into outer lock core 270 in outer cylinder 26 to unlock outer lock core 270 and to rotate outer lock core 270 and actuating block 255. Ear 257 of actuating block 255 is rotated to press against tab 422 of mover 42. Tab 422 of mover 42 pushes second protruded portion 332 of limiting member 32 so that stop 324 of limiting member 32 rotates toward first section 348 of sliding member 34 until stop 324 abuts on top of first section 348 of sliding member 34. In this case, limiting member 32 is in a blocking position (FIG. 16). Furthermore, when limiting member 32 rotates, second tang 358 of spring 354 rotates about a pivot axis defined by first tang 356 to a position retaining limiting member 32 in the blocking position. Movement of sliding member 34 is blocked by limiting member 32 so that actuating member 36 and follower 38 can not rotate. Thus, handle 24 can not be rotated. In this state, unlatching can not be achieved through operation of handle 24. A deadlocking function is, thus, provided.

When it is desired to remove the deadlocking setting from outer side 10*b* of door 10, key 60 is inserted into outer lock core 270. Outer lock core 270 and actuating block 255 are rotated when key 60 is rotated, so that ear 257 of actuating block 255 is rotated to press against tab 422 of mover 42 in a reverse direction. Tab 422 of mover 42 pushes first protruded portion 330 of limiting member 32 so that limiting member 32 rotates clockwise. At the same time, second tang 358 of spring 354 is pulled and rotates about the pivot axis defined by first tang 356, such that spring 354 returns to a position retaining limiting member 32 in the release position (FIG. 5). Movement of sliding member 34 is no longer blocked by limiting member 32 so that actuating member 36 and follower 38 can rotate. Thus, handle 24 can be rotated for unlatching purposes.

Figure 17:
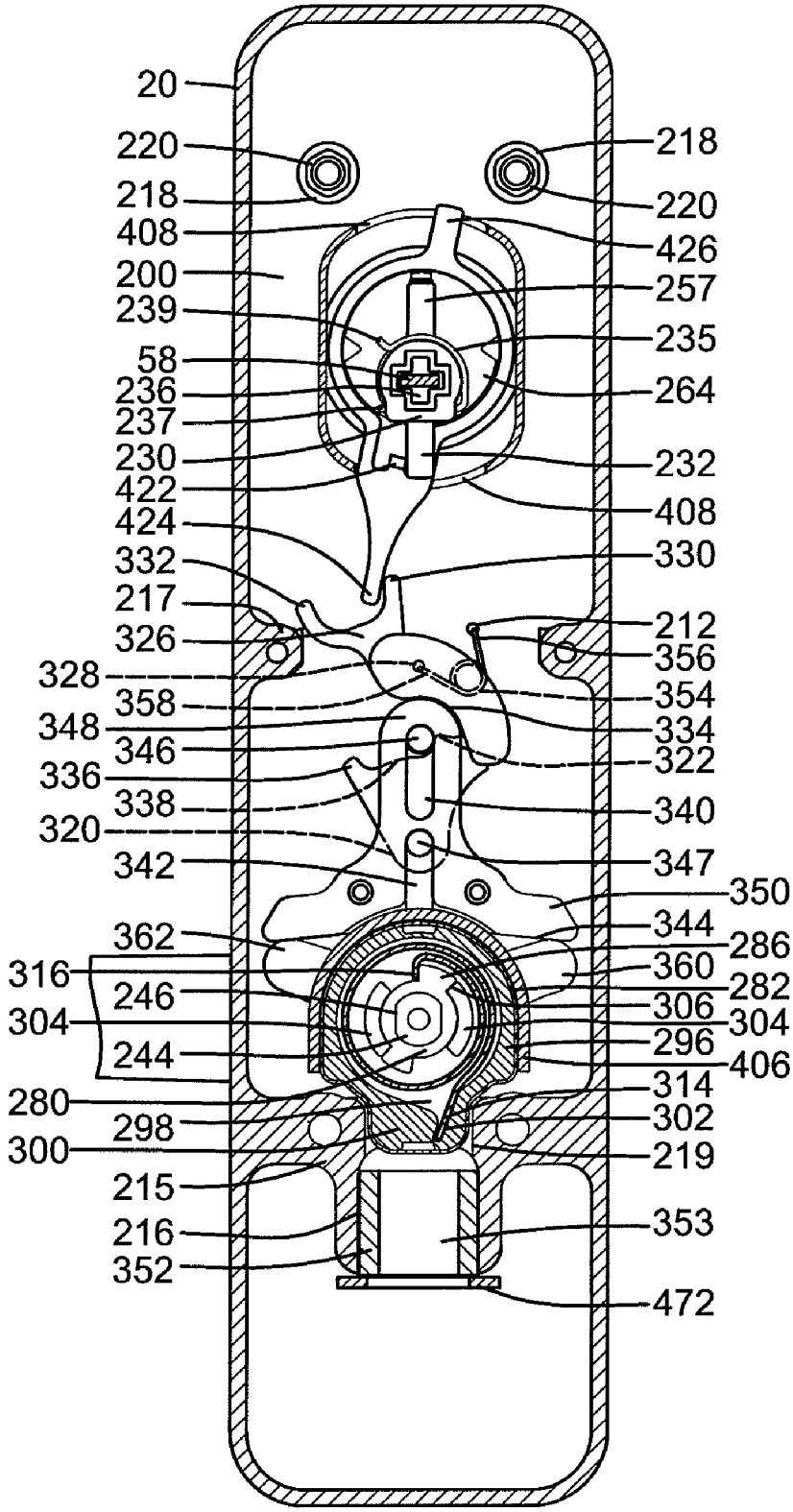
FIG. 17 is a view similar to FIG. 5 with the inner cylinder operated to provide a deadlocking function.

To set the deadlocking function from inner side 10*a* of door, key 60 is inserted into inner lock core 54 in inner cylinder 50 to unlock inner lock core 54. Inner lock core 54, tongue 58, and driving block 230 are rotated when key 60 is rotated. Lug 232 of driving block 230 is rotated to press against tab 422 of mover 42. Tab 422 of mover 42 pushes second protruded portion 332 of limiting member 32 so that stop 324 of limiting member 32 rotates toward first section 348 of sliding member 34 until stop 324 abuts on top of first section 348 of sliding member 34. In this case, limiting member 32 is in a blocking position (FIG. 17). Furthermore, when limiting member 32 rotates, second tang 358 of spring 354 rotates about a pivot axis defined by first tang 356 to a position retaining limiting member 32 in the blocking position. Movement of sliding member 34 is blocked by limiting member 32 so that actuating member 36 and follower 38 can not rotate. Thus, handle 24 can not be rotated. In this state, unlatching can not be achieved through operation of handle 24. A deadlocking function is, thus, provided.

When it is desired to remove the deadlocking setting from inner side 10*a* of door 10, key 60 is inserted into inner lock core 54 in inner cylinder 50 to rotate inner lock core 54, tongue 58, and driving block 230. Lug 232 of driving block 230 is rotated to press against tab 422 of mover 42 in a reverse direction. Tab 422 of mover 42 pushes first protruded portion 330 of limiting member 32 so that limiting member 32 rotates clockwise. At the same time, second tang 358 of spring 354 is pulled and rotates about the pivot axis defined by first tang 356, such that spring 354 returns to a position retaining limiting member 32 in the release position (FIG. 5). Movement of sliding member 34 is no longer blocked by limiting member 32 so that actuating member 36 and follower 38 can rotate. Thus, handle 24 can be rotated for unlatching purposes.

The panic exit door lock according to the preferred teachings of the present invention allows setting of deadlocking function from either inner side 10*a* or outer side 10*b* of door 10 through simple operation, which is user-friendly. Furthermore, the panic exit door lock according to the preferred teachings of the present invention can be modified from the panic exit door lock disclosed in U.S. patent application Ser. No. 12/264,310 at low costs. Specifically, only actuating block 255 is modified and locking mechanism 3 is added. The entire contents of U.S. patent application Ser. No. 12/264,310 are incorporated herein by reference.

Now that the basic teachings of the present invention have been explained, many extensions and variations will be obvious to one having ordinary skill in the art. For example, follower 380 can include only one tooth 38. Resilient clip 235 can have other shapes while achieving the same function. Tongue 58 can be made of a rigid material, and coupling hole 236 can have a length sufficient long for receiving tongue 58 without the need of breaking tongue 58 to obtain the desired length.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A panic exit door lock comprising, in combination:

a base (130) adapted to be mounted to an inner side (10*a*) of a door (10);

a sliding device (14) slideably mounted to the base (130);

a latch (120) operably coupled to the sliding device (14) and movable between an extended, latching position and a retracted, unlatching position;

a cover (20) adapted to be mounted to an outer side (10*b*) of the door (10);

a sliding member (34) slideably received in the cover (20) and operably connected to the sliding device (14);

a handle (24) pivotably mounted to the cover (20) and operably connected to the sliding member (34) such that rotation of the handle (24) causes sliding of the sliding member (34), moving the latch between the extended, latching position and the retracted, unlatching position;

a limiting member (32) pivotably received in the cover (20) between a blocking position not allowing movement of the sliding member (34) and a release position allowing movement of the sliding member (34), with the handle (24) being rotatable when the limiting member (32) is in the release position, with the handle (24) being not rotatable when the limiting member (32) is in the blocking position;

an outer cylinder (26) including an outer cylinder body (264) mounted to the cover (20) and an outer lock core (270) rotatably received in the outer cylinder body (264);

an actuating block (255) fixed to the outer cylinder core (270) to rotate therewith;

a driving member (44) fixed to the sliding member (34) to move therewith, with the driving member (44) including a rod (442) coupled to the sliding device (14);

a mover (42) rotatably mounted around the cylinder (26) and including a tab (422) and an actuating bar (424), with the tab (422) being operably connected to the actuating block (255), with the actuating bar (424) being operably connected to the limiting member (32), with the mover (42) being rotated to move the limiting member (32) between the blocking position and the release position when the actuating block (255) is rotated by rotating the outer lock core (270);

a casing (122) adapted to be mounted to the inner side (10*a*) of the door (10);

an inner cylinder (50) including an inner cylinder body (52) mounted to the casing (122) and an inner lock core (54) rotatably received in the inner cylinder body (52);

a driving block (230) rotatably mounted around the actuating block (255), with the driving block (230) being operably connected to the tab (422) of the mover (42); and a tongue (58) including front and rear ends (582, 584) spaced in a longitudinal direction, with the rear end (584) fixed to the inner lock core (54), with the front end (582) coupled to the driving block (230), allowing joint rotation of the inner lock core (54), the tongue (58), and the driving block (230), with the mover (42) being rotated to move the limiting member (32) between the blocking position and the release position when the driving block (230) is rotated by rotating the inner lock core (54).

2. The panic exit door lock as claimed in claim 1, with the actuating block (255) including a main portion (256) having an ear (257) extending radially outward from an outer periphery of the main portion (256), with the ear (257) driving the tab (422) of the mover (42) to rotate the mover (42) when the outer lock core (270) is rotated, moving the limiting member (32) between the blocking position and the releasing position.

3. The panic exit door lock as claimed in claim 2, with the main portion (256) including a coupling portion (258) extending from a side thereof, with the driving block (230) including first and second ends (231, 233) spaced in the longitudinal direction, with the first end (231) of the driving block (230) including a receptacle (238) rotatably receiving the coupling portion (258).

4. The panic exit door lock as claimed in claim 3, with a lug (232) extending radially outward from an outer periphery of the first end (231) of the driving block (230), with the lug (232) driving the tab (422) of the mover (42) to rotate the mover (42) when the inner lock core (54) is rotated, moving the limiting member (32) between the blocking position and the releasing position.

5. The panic exit door lock as claimed in claim 3, with the coupling portion (258) including an annular groove (259) in the outer periphery thereof, with the driving block (230) including an engaging hole (234) extending from an outer periphery of the driving block (230) to the receptacle (238) in a radial direction perpendicular to the longitudinal direction, with the panic exit door lock further comprising, in combination: a resilient clip (235) having a first end (237) extending through the engaging hole (234) into the annular groove (259) of the coupling portion (258), with the resilient clip (235) further including a second end (239) abutting the outer periphery of the driving block (230), allowing relative rotation between the actuating block (255) and the driving block (230) and preventing relative movement between the actuating block (255) and the driving block (230) in the longitudinal direction.

6. The panic exit door lock as claimed in claim 5, with the coupling portion (258) including two longitudinal grooves (260), with the main portion (256) including two through-holes (278) aligned with the longitudinal grooves (260), with the outer lock core (270) including two screw holes (273) in an end face thereof, with the panic exit door lock further comprising, in combination: two fasteners (269) received in the two grooves (260) and extended through the two through-holes (278) into the two screw holes (273), allowing joint rotation of the actuating block (255) and the outer lock core (270).

7. The panic exit door lock as claimed in claim 5, with the second end (233) of the driving block (230) including a non-circular hole (236), and with the front end (582) of the tongue (58) securely received in the non-circular hole (236).

8. The panic exit door lock as claimed in claim 6, with the inner lock core (54) including a head (540) and a tail (542) spaced in the longitudinal direction, with the tail (542) of the inner lock core (54) including an annular groove (546) in an outer periphery thereof, with the tail (542) of the inner lock core (54) further including a groove (543) extending from an end face of the tail (542) towards but spaced from the head (540) in the longitudinal direction and intersecting and in communication with the annular groove (546), with the rear end (584) of the tongue (58) including an ear (586) on each of two sides thereof, with the ears (586) received in the groove (543) of the tail (542) of the inner lock core (54), with the panic exit door lock further comprising, in combination: a positioning ring (550) mounted around the inner lock core (54) between the groove (543) and the head (540) of the inner lock core (54); and a retainer ring (552) engaged in the annular groove (546) of the tail (542) of the inner lock core (54), positioning the positioning ring (550) between the retainer ring (552) and a rear end face (523) of the inner cylinder body (52), with the positioning ring (550) preventing the ears (586) of the tongue (58) from extending out of the groove (543) of the inner lock core (54), with the retainer ring (552) retaining the ears (586) of the tongue (58) in a position behind the annular groove (546), preventing the tongue (58) from disengaging from the groove (543) of the inner lock core (54).

9. The panic exit door lock as claimed in claim 8, with the tongue (58) including an upper surface having a plurality of slots (588) between the front and rear ends (582, 584) and spaced in the longitudinal direction, and with the tongue (58) being breakable along any one of the plurality of the slots (588) to adjust a length of the tongue (58) in the longitudinal direction.

10. The panic exit door lock as claimed in claim 1, with the end face of the inner cylinder body (54) having a plurality of screw holes (525), with the base (130) including upper and lower guiding mechanisms (132) on a side of the base (130) and spaced in a vertical direction perpendicular to the longitudinal direction, with the sliding device (14) mounted to the lower guiding mechanism (132), with the panic exit door lock further comprising, in combination: a connecting board (140) mounted to the upper guiding mechanism (132); a locking plate (150) mounted to another side of the base (130); and a plurality of screws (158) extending through the locking plate (150) and the connecting board (140) into the plurality of screw holes (525) of the inner cylinder body (54).

11. The panic exit door lock as claimed in claim 10, with the upper guiding mechanism (132) including two tabs (134) extending in the vertical direction and each having upper and lower ends, with the connecting plate (140) further including first and second lateral sides (142) each having upper and lower ends, with a restraining portion (144) extending inward from each of the upper and lower ends of each of the first and second lateral sides (142), with a spacing between a pair of aligned upper and lower restraining portions (144) being generally equal to a length of each of the two tabs (134) in the vertical direction, with the connecting board (140) being mounted to the two tabs (134), with the lateral sides (142) aligned with the two tabs (134), with two upper ones of the restraining portions (144) abutting the upper ends of the two tabs (134), and with two lower ones of the restraining portions (144) abutting the lower ends of the two tabs (134).

* * * * *